US010815028B1

(12) United States Patent
Turner et al.

(10) Patent No.: US 10,815,028 B1
(45) Date of Patent: Oct. 27, 2020

(54) MULTI-USE PALLET

(71) Applicant: Macro Plastics, Inc., Fairfield, CA (US)

(72) Inventors: Todd T. Turner, Corydon, IN (US); Jeffrey W. Mitchell, Louisville, KY (US)

(73) Assignee: MACRO PLASTICS, INC., Fairfield, CA (US)

( * ) Notice: Subject to any disclaimer, the term of this patent is extended or adjusted under 35 U.S.C. 154(b) by 0 days.

(21) Appl. No.: 16/569,926

(22) Filed: Sep. 13, 2019

Related U.S. Application Data

(60) Provisional application No. 62/731,382, filed on Sep. 14, 2018.

(51) Int. Cl.
*B65D 19/00* (2006.01)
*E01C 9/08* (2006.01)

(52) U.S. Cl.
CPC ..... *B65D 19/0073* (2013.01); *B65D 19/0067* (2013.01); *B65D 19/0071* (2013.01); *E01C 9/08* (2013.01); *E01C 9/086* (2013.01); *B65D 2519/00273* (2013.01); *B65D 2519/00293* (2013.01); *B65D 2519/00746* (2013.01)

(58) Field of Classification Search
CPC ..... B65D 19/0067; B65D 19/0071; B65D 19/0073; E01C 9/08; E01C 9/086
USPC ..... 108/54.1
See application file for complete search history.

(56) References Cited

U.S. PATENT DOCUMENTS

| | | | | |
|---|---|---|---|---|
| 4,571,353 | A * | 2/1986 | Gable, Jr. | A47G 27/0293 52/592.1 |
| 5,222,342 | A * | 6/1993 | Defferrari | E02D 17/205 52/575 |
| 6,089,784 | A | 7/2000 | Ardern | |
| 6,244,502 | B1 | 6/2001 | Hollar et al. | |
| 6,327,984 | B1 | 12/2001 | McCann et al. | |
| D465,857 | S | 11/2002 | Ardern | |
| 6,543,969 | B1 | 4/2003 | Adam | |
| D524,952 | S | 7/2006 | Ardern | |
| 7,162,838 | B2 * | 1/2007 | Ardern | E01C 9/08 52/127.9 |
| 7,165,694 | B2 | 1/2007 | Schutz | |
| D556,921 | S | 12/2007 | Ardern | |
| 8,161,893 | B2 | 4/2012 | Kindellan | |
| 8,881,898 | B2 | 11/2014 | DeForest | |
| 9,120,593 | B2 | 9/2015 | Mena et al. | |

(Continued)

FOREIGN PATENT DOCUMENTS

| | | |
|---|---|---|
| CA | 1133301 | 10/1982 |
| DE | 2348341 A1 | 4/1975 |

(Continued)

*Primary Examiner* — Kyle R Grabowski
(74) *Attorney, Agent, or Firm* — Wyatt, Tarrant & Combs, LLP; Max E. Bridges; Matthew A. Williams

(57) ABSTRACT

A multi-use pallet comprising a main body member, a male wing member, a female wing member, and a pair of risers, wherein the components can be re-arranged and interconnected with one another into a variety of other configurations and uses such as elevated flooring, roadways, temporary pathways, and walls. The interconnectivity of the multi-use pallet components provide an array of versatile uses to the user, and the arrangement of parts provides greater structural support and higher load-bearing potential.

18 Claims, 35 Drawing Sheets

(56) References Cited

U.S. PATENT DOCUMENTS

| | | | | |
|---|---|---|---|---|
| 9,133,599 | B2 | 9/2015 | Henning et al. | |
| 9,228,299 | B2 | 1/2016 | Brown | |
| 9,840,841 | B2 | 12/2017 | Gosling et al. | |
| 9,845,990 | B2 | 12/2017 | Wagner | |
| 2009/0064906 | A1* | 3/2009 | Cance | B65D 19/0038 108/56.3 |

FOREIGN PATENT DOCUMENTS

| | | | | |
|---|---|---|---|---|
| DE | 2401303 | A1 * | 7/1975 | E01C 19/52 |
| DE | 2401303 | A1 | 7/1975 | |
| EP | 0013896 | A1 * | 8/1980 | E01C 5/06 |
| EP | 0013896 | A1 | 8/1980 | |
| EP | 2216255 | A1 | 8/2010 | |

* cited by examiner

MULTI-USE PALLET

CROSS-REFERENCE TO RELATED APPLICATIONS

This patent application claims the benefit of and priority to U.S. Provisional Patent Application Ser. No. 62/731,382, with a filing date of Sep. 14, 2018, the contents of which are fully incorporated herein by reference.

FIELD OF INVENTION

The embodiments described herein relate to pallets made of multiple components that can be re-arranged and interconnected into a number of other configurations and uses such as elevated flooring, roadways, temporary pathways, and walls. When used as a pallet, the present embodiments integrate an improved load-bearing system. When utilized as flooring, the present embodiments integrate features that strengthen and elevate the flooring above the ground.

BACKGROUND

In the distribution industry, it is common to support goods in a stable fashion using a pallet. A pallet is a flat transport structure that allows for improved handling and storage efficiencies of goods. For example, when goods are supported by a pallet, the goods can be easily lifted and handled by a forklift, a jack, a front loader, a crane, and so forth. Most pallets provide the capability to lift and move a stack of goods with a pallet truck or forklift, which permits the movement of multiple goods at the same time without handling each individual article. In addition, goods can be easily secured to a pallet (e.g. with strapping or shrink wrap), which aids in the transportation and shipment of goods.

The last century of globalization has resulted in a great increase in the use of standardized shipping containers to transport goods. These standardized containers can be easily loaded and unloaded, stacked, and transported via a variety of modes such as by boat or rail. This global boom in the use of standardized shipping containers has also spurred the use of pallets that can be easily utilized within shipping containers because these containers have the smooth, level surfaces needed for easy pallet movement. In the United States alone, it is estimated that more than two billion pallets are in use on any given day.

Pallets can be manufactured from a variety of materials such as wood, plastic, metal, and paper. However, the most commonly used pallets are made of lightweight and inexpensive wood. These conventional wooden pallets are typically designed for onetime, temporary use and often consist of three to four crossbeams that support several deck-boards, on top of which the goods are placed.

The use of the conventional wooden pallet presents a number of disadvantages to the transportation, shipping, and handling industry. In particular, after the onetime use these wooden pallets must be stored, thrown away, or otherwise disposed. For example, the military frequently utilizes wooden pallets to transport a variety of goods (such as Meals-Ready-to-Eat, also known as "MREs") across the globe. Once the goods are delivered, the wooden pallets must either be stored, burned, or otherwise discarded. This wasteful use of the wooden pallets presents a significant problem to the military, as well as the global shipment industry at large.

Accordingly, there is a need for a reusable and versatile pallet that can be utilized for a variety of purposes other than simply shipping goods. There is also a need for a pallet that employs other materials than wood to ensure the pallet maintains its structural robustness throughout its life span.

In addition to the need for a reusable, versatile, and structurally sound pallet, there is also a need for re-arranging and interconnecting a number of like panels suitable for a variety of other uses such as walkways, roadways, and flooring. For example, the military has a need to quickly and efficiently construct roadways, airfield runways, and tent platforms often upon virgin ground. In the civil construction industry, it is also necessary to quickly construct a variety of interconnected panels for moving heavy machinery around a work site, constructing temporary work stations, and so forth. In general, the same problem is encountered whenever there is a great amount of people assembled in a temporary location, especially during certain periods of the year when the ground is saturated or in harsh climates, like the desert, which can impact machinery, living quarters, and the like. The need for temporary but durable panels may also arise at festivals, sporting events, or any type of gathering with a large number of people.

It is known to utilize an I-shaped component to build up an array of similar I-shaped components suitable for a variety of uses. For example, U.S. Pat. No. 7,162,838 describes a panel with a rectangular central section and two opposed end sections, wherein each end section has an isosceles trapezoid part, its short edge is conjoined to an edge of the central section and its long edge is conjoined to a rectangular part, there being oblique edges extending between the long and short edges. Some of the edges of the panel contain projecting tabs that are received in corresponding receptors on opposed edges and contain locking arrangements, whereby the various panels may be integrated and locked to each other.

However, the conventional array of panels described in U.S. Pat. No. 7,162,838 presents a number of disadvantages. In particular, this assembled array can only have jagged edges. This presents a problem when using the conventional array for roads, walkways, and flooring because the jagged edges could damage vehicles and present a safety hazard for those walking on the temporary pathways. In addition, the jagged edges make it easier to damage the projecting tabs that are not protected from the car and/or foot traffic and are also exposed to the elements. Moreover, the joints between these conventional panels are not reinforced with risers/runners, and thus the interconnections between the conventional panels are weak and lack the load-bearing capabilities needed for a variety of uses, like roads. Instead, these conventional panels are merely held together by a small hook and lock member.

Furthermore, this conventional array of panels cannot be elevated above the ground. This is a major disadvantage when the ground is saturated and/or the array is located in a harsh environment. For example, if the conventional array is used as flooring and a rainstorm occurs, the entire flooring could be flooded. Also, in the military context, there is a significant need for elevated flooring so that items in a temporary structure (i.e. a tent) are elevated above the ground such that electrical cables, water lines, and so forth can run beneath the flooring of the temporary structure. For example, in a hot desert climate it is highly desirable for desks, tables, and so forth to rest well above the hot, desert sands.

Accordingly, there is a significant need for a reusable, versatile, and structurally sound pallet that can also be re-arranged and interconnected with like components into a number of other configurations and uses such as elevated flooring, roadways, temporary pathways, and walls. There is also a need for a reinforced, temporary flooring that has greater load-bearing potential and is elevated above the ground. Likewise, there is a need for an arrangement of panels that have straight edges, which can be easily used for roadways and pathways. This significant need exists in any industry that utilizes pallets and has a need for a temporary but durable array of components. Along with other features and advantages outlined herein, the multi-use pallets within the scope of present embodiments meet these and other needs. In doing so, the inventive pallet provides greater load bearing potential when utilized as a pallet and can withstand greater loads when re-configured into temporary flooring. Also, when re-arranged into flooring, the present embodiments elevate the flooring above the ground.

SUMMARY OF EMBODIMENTS

A multi-use pallet, sometimes referred to herein as a "pallet" for brevity, according to multiple embodiments and alternatives provides greater structural support, is reusable, and its components may be re-arranged into a variety of other configurations. Accordingly, the multi-use pallet according to present embodiments may be utilized as a pallet to provide structural support for goods, and its components may be re-arranged and utilized for a number of other purposes including but not limited to elevated flooring, roads, pathways, and walls.

Current embodiments provide for a pallet comprising a main body member, a male wing member, a female wing member, and a pair of risers. In some embodiments, the main body member comprises a central section and two end sections. The central section is a square or rectangular shape, and each end section consists of a trapezoid part integrally connected to a rectangular part. The trapezoid part of the end section comprises parallel long and short lengths and a pair of external oblique lengths. The rectangular part of the end section comprises a pair of parallel, external short lengths, and a pair of long lengths. The short length of the trapezoid part is integrally connected to an end length of the central section and the long length of the trapezoid part is integrally connected to an internal long length of the rectangular part. The external length of the rectangular part is external to the main body member.

In some embodiments, the main body member consists of a first side, a second side, a first end, a second end, and identical top and bottom surfaces. As such, the main body member can be used as a pallet or re-assembled into other configurations in any orientation.

According to present embodiments, the first side of the main body member is configured to receive the male wing member and the second side of the main body member is configured to engage the female wing member. In some embodiments, the internal sides of the male wing members include ribs that engage with corresponding slots located on the first side of the main body member. Further, the second side of the main body member includes ribs that engage with the corresponding slots located on the internal sides of the female wing member. The first end of the main body member may also include a slot adapted to receive a rib located on the second end of another main body member.

As used herein, the male and female wing members are distinguished only by the presence of ribs: the male wing members have ribs on their internal sides while the female wing members have slots on their internal sides. However, in certain embodiments every other feature of the male and female wing members are the same. In regards to the shape, both wing members consist of a trapezoid section integrally attached to a rectangular section. In addition, both wing members have top and bottom surfaces, wherein the top surfaces include non-slip patterns and the bottom surfaces comprise reinforcing grid patterns to provide additional stability and support.

In some embodiments, certain sides of the main body member, the male wing member, and the female wing member include projections (referred to herein as "fingers") that are received in one or more corresponding notches that are adapted to receive each projection. For example, fingers are located on the external sides of the central section and these fingers engage with the corresponding notches located on the internal sides of the male and female wing members. Likewise, fingers are located on the internal sides of the male and female wing members, and these fingers engage corresponding notches located on the first and second sides of the main body member. As discussed in more detail below, the fingers and notches of the main body member may also engage the fingers and notches located on other main body members. As disclosed herein, the interconnectivity of the various components results in a variety of configurations, in addition to a pallet, that may be useful as elevated flooring, pathways, and so forth.

In addition to the ribs and corresponding slots, according to multiple embodiments the wing members and the main body member are locked to one another by lock members. In some embodiments, a bore can be located adjacent and perpendicular to the notches so that the lock members are configured to engage and secure the fingers after they have been inserted into the corresponding notches. When inserting the fingers into the notches, the locking mechanism is positioned in the open position. After insertion, the locking mechanism can be rotated to lock the fingers in place. In some embodiments, the lock members secure the wing members to the main body member. As discussed in more detail below, the lock members are also configured to lock female and male wing members together, as well as main body members to other main body members.

The multi-use pallet may also include risers that can be secured to the first and second ends of the main body member, as well as the wing members, in any suitable fashion. In current embodiments, the risers are secured to the main body member by the use of nuts and bolts. In this embodiment, both the main body member and the risers include bolt receiving holes that are adapted to receive a bolt. In this arrangement, the risers are placed below the main body member and arranged such that the bolt receiving holes align. A bolt can then be inserted into the main body member and into the risers, such that the bolt extends from the main body member, through the riser, and out of the bottom surface of the riser. A nut can be then placed onto the bottom of the bolt and tightened until the riser is secured to the main body member. In some embodiments, bolt receiving holes are located in the male and female wing members such that the risers can be secured to the wings to provide additional structural support, greater load-bearing potential, and provide a variety of configurations.

According to present embodiments, the risers also comprise a middle section and two sections. The riser includes a series of internal cells, internal walls, and slots which provide additional support and stability. In addition, the riser includes a top and a bottom, wherein the bottom also includes nut receiving holes that are adapted to receive the nuts which are used to tighten the bolts in place. In some embodiments, the riser includes a step to allow strapping to pass through.

Accordingly, the main body, the male wing member, the female wing member, and risers may be interconnected for use as a traditional pallet. In this configuration, both the male and female wing members are connected to the main body member via the corresponding ribs and slots, as well as the corresponding fingers and notches. After insertion into the corresponding notches, the fingers can be secured in place using the lock mechanism. In some embodiments, the lock mechanism comprises a cam arrangement, such that after insertion of the finger, the locking cam can be rotated to securely attach the wing members to the main body section. Next, pair of the risers can be secured to the main body section using nuts and bolts. Once interconnected in this configuration, the components may be utilized as a pallet to support goods.

The various components of the multi-use pallet may also be re-arranged into a number of other configurations that may be useful for a variety of other purposes such as elevated flooring, pathways, roadways, and walls. According to present embodiments, a weight-bearing array may be created by connecting any number of main body members to other main members. In this arrangement, the ribs and fingers of the main body members interconnect with one another and can be secured in place using the lock mechanisms. As discussed in more detail below, this configuration results in jagged edges that can be straightened by attaching male and female wing members to the edges of the array of main body members. This weight-bearing, rectangular array, comprising main body members, male and female wing members, half main body members, and corner members, can be elevated above the ground by attaching risers to the bottom of the array. The addition of the risers both elevates and provides additional structural support for the array. A user can utilize as many of these components as needed to create whatever sized array is desired and needed. Furthermore, this configuration could be used for any number of purposes such as elevated flooring, walkways, and so forth.

According to present embodiments, the male and female wing members and corner members can be connected to one another to form an elongated weight-bearing array. In this arrangement, the ribs of the male wing members interconnect with the corresponding slots on the female wing members. In addition, the fingers are inserted into the corresponding notches and are secured in place by the locking mechanism. This array (with only male and female wing members and corner members) could be utilized for a variety of purposes such as a roadway or walkway. In addition, this array can be elevated above the ground by attaching risers to the bottom of the configuration.

In current embodiments, the components of the multi-use pallet may be re-arranged into a variety of configurations as chosen by and most useful to the user. Furthermore, the interconnectivity of the components, combined with the internal support structures, provide greater structural support then conventional pallets. In addition, when re-arranged into an array, the configuration of the components provides increased load bearing potential than conventional multi-panel systems.

Accordingly, the multi-use pallet in current embodiments provides a versatility of uses that provides a key advantage over conventional multi-panel arrays. While the components may be used as pallet, the components may be easily and quickly re-arranged into any number of configurations disclosed herein. Along with other features disclosed herein, the versatility and re-usability of the multi-use pallet provides a number of advantages over both the conventional pallet and the conventional multi-panel array.

BRIEF DESCRIPTION OF THE FIGURES

The drawings and embodiments described herein are illustrative of multiple alternative structures, aspects, and features of the present embodiments, and they are not to be understood as limiting the scope of present embodiments. It will be further understood that the drawing Figures described and provided herein are not to scale, and that the embodiments are not limited to the precise arrangements and instrumentalities shown.

MULTIPLE EMBODIMENTS AND ALTERNATIVES

Figure 3:
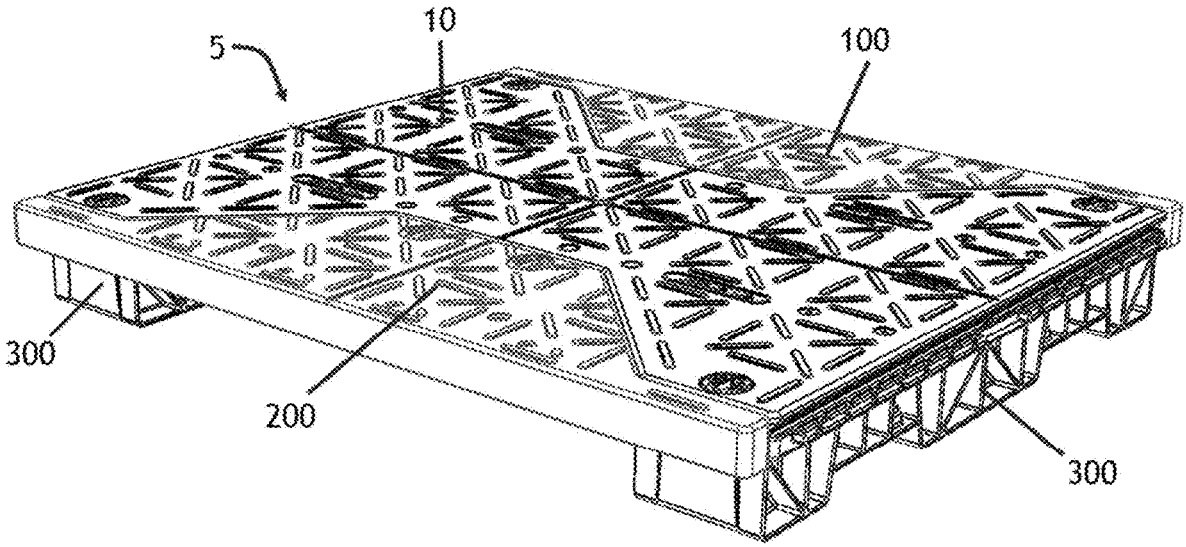
FIG. 3 is a perspective view of a multi-use pallet, according to multiple embodiments and alternatives.
Figure 4:
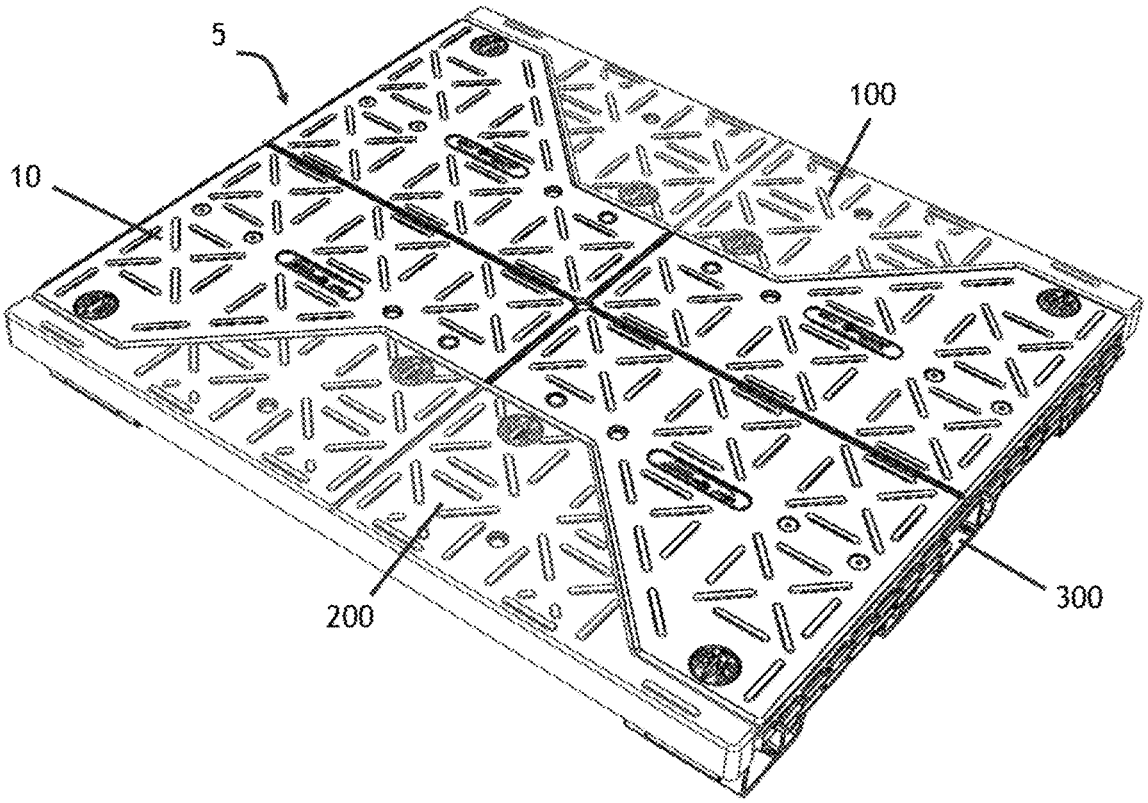
FIG. 4 is a perspective view of a multi-use pallet, according to multiple embodiments and alternatives.
Figure 5:
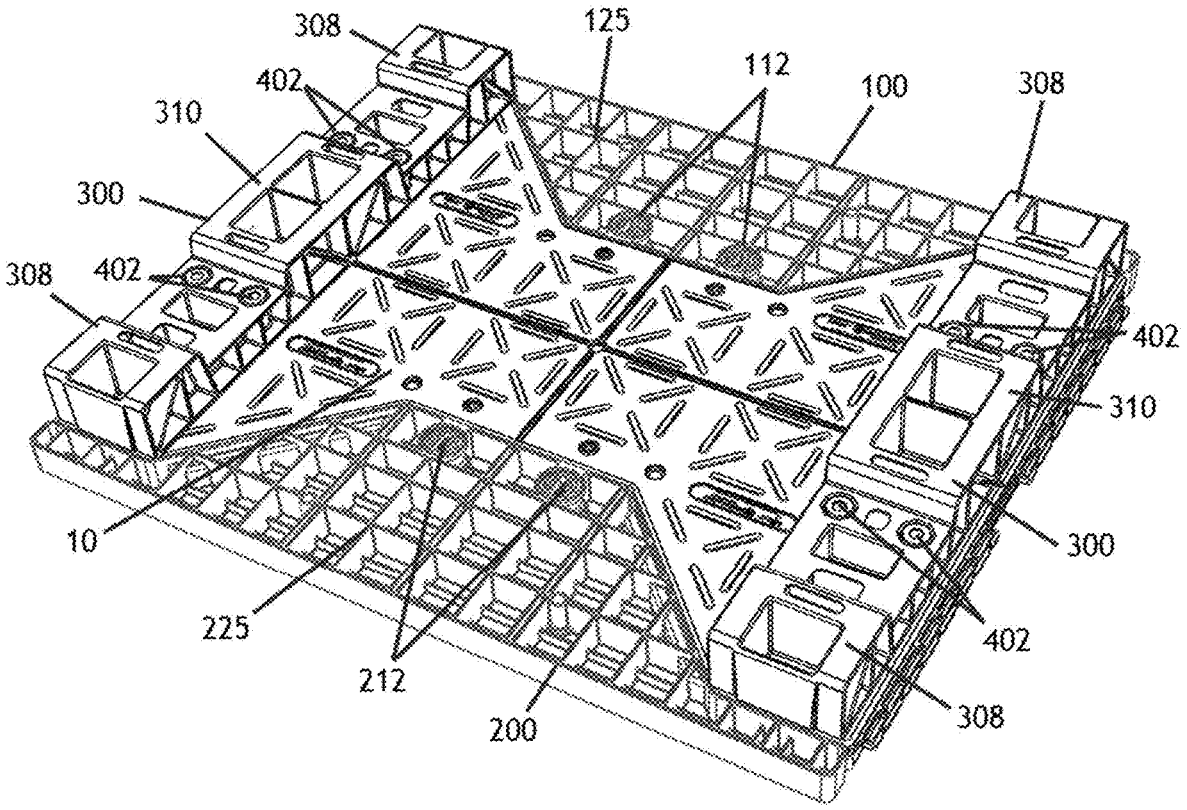
FIG. 5 is a perspective bottom view of a multi-use pallet, according to multiple embodiments and alternatives.
Figure 6:
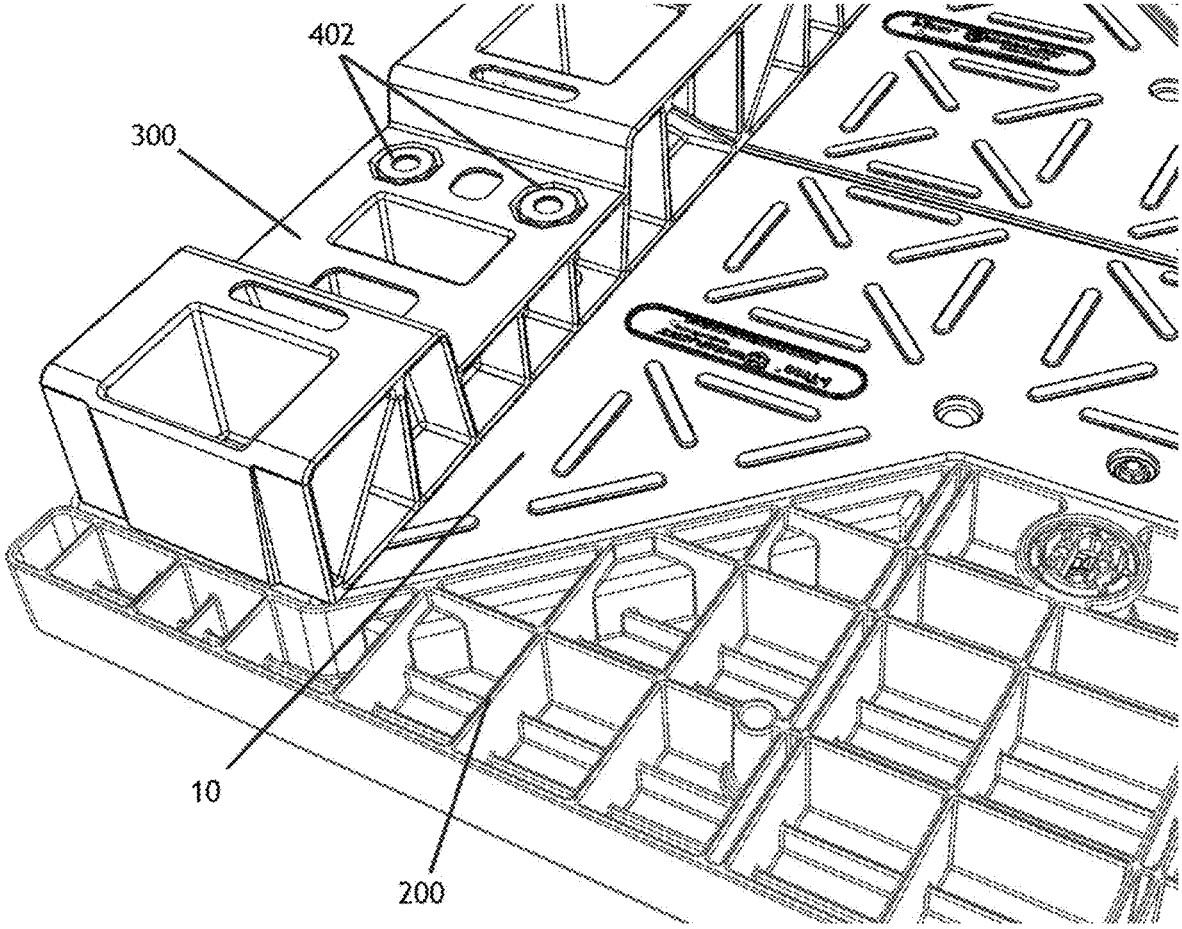
FIG. 6 is close-up, perspective, and bottom view of a multi-use pallet, according to multiple embodiments and alternatives.
Figure 7:
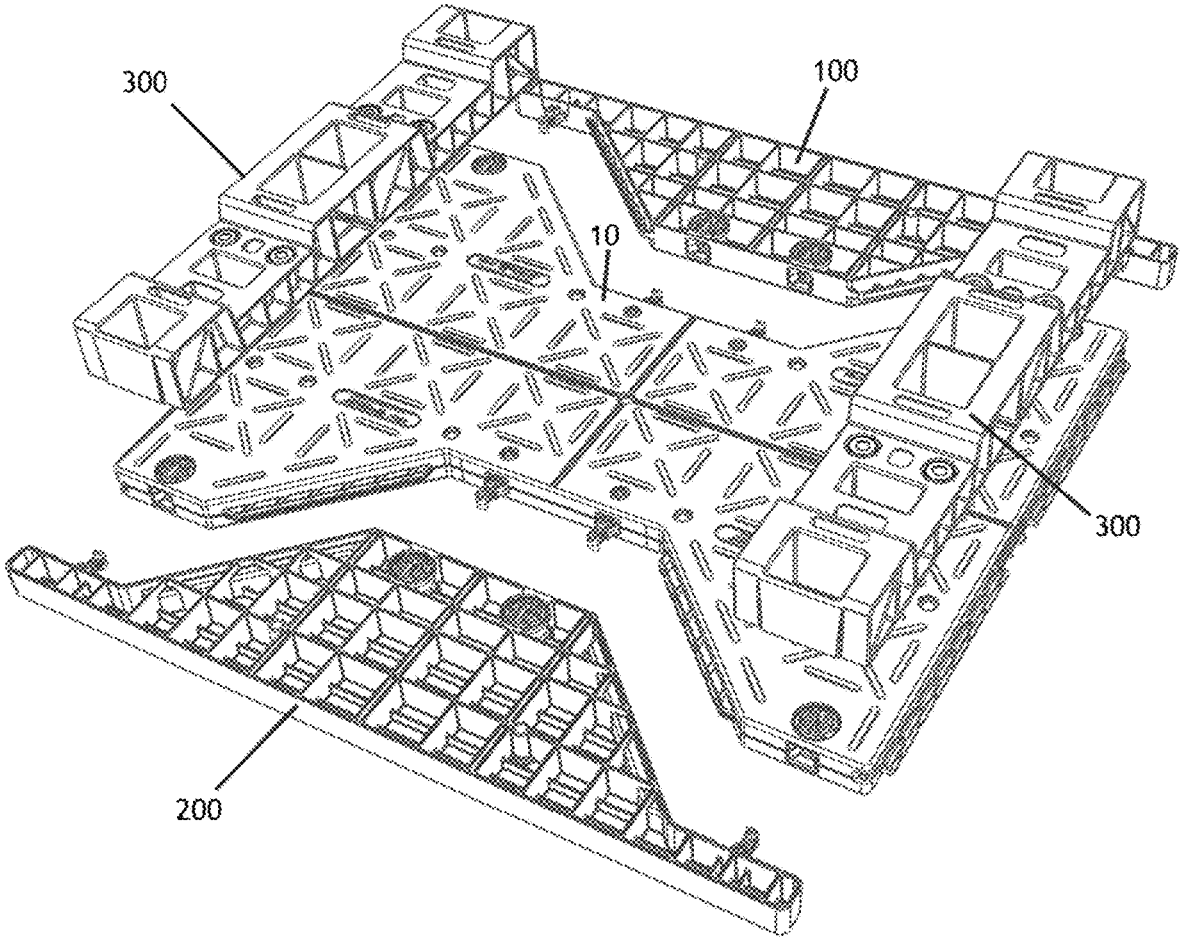
FIG. 7 is a perspective, bottom, and exploded view of a multi-use pallet, according to multiple embodiments and alternatives.

FIGS. 3 and 4 show an assembled multi-use pallet 5 according to multiple embodiments and alternatives. An assembled multi-use pallet 5 consists of a main body member 10, a male wing member 100, a female wing member 200, and a pair of risers 300. The main body member 10 is generally in the shape of the letter "I."

The multi-use pallets may be manufactured in any number of sizes, including but not limited to the standard pallet size of 40" by 48". This is referred to as a GMA Pallet. The acronym, GMA, is short for the Grocery Manufacturers Association which is the organization that sets the standard for the pallet that is used in the grocery industry. There are thousands of other sizes, but the GMA Pallet is the most popular. The multi-use pallet may also be manufactured from any type of material that is suitable to those in the industry, such as plastic, wood, and metal.

Figure 1:
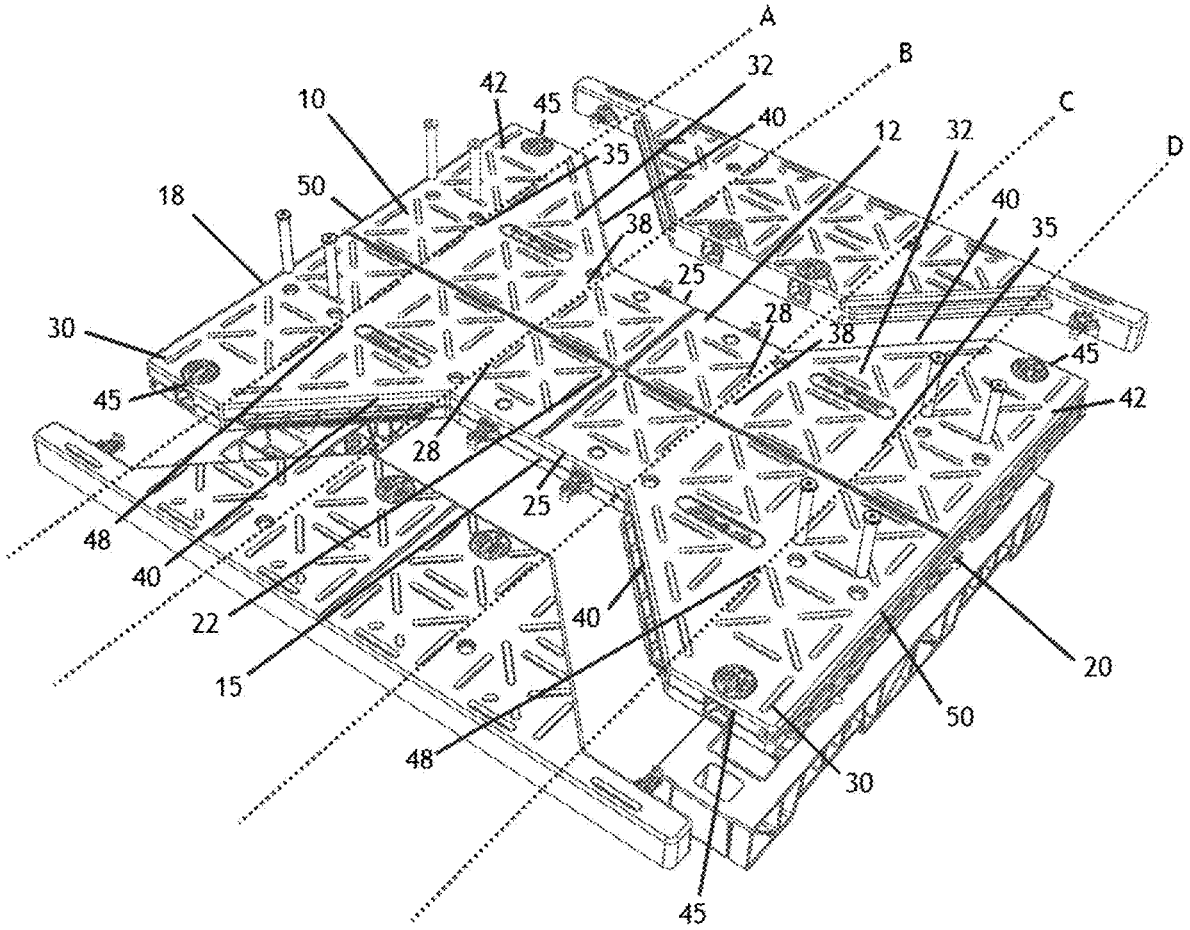
FIG. 1 is a perspective exploded view of a multi-use pallet, according to multiple embodiments and alternatives.
Figure 2:
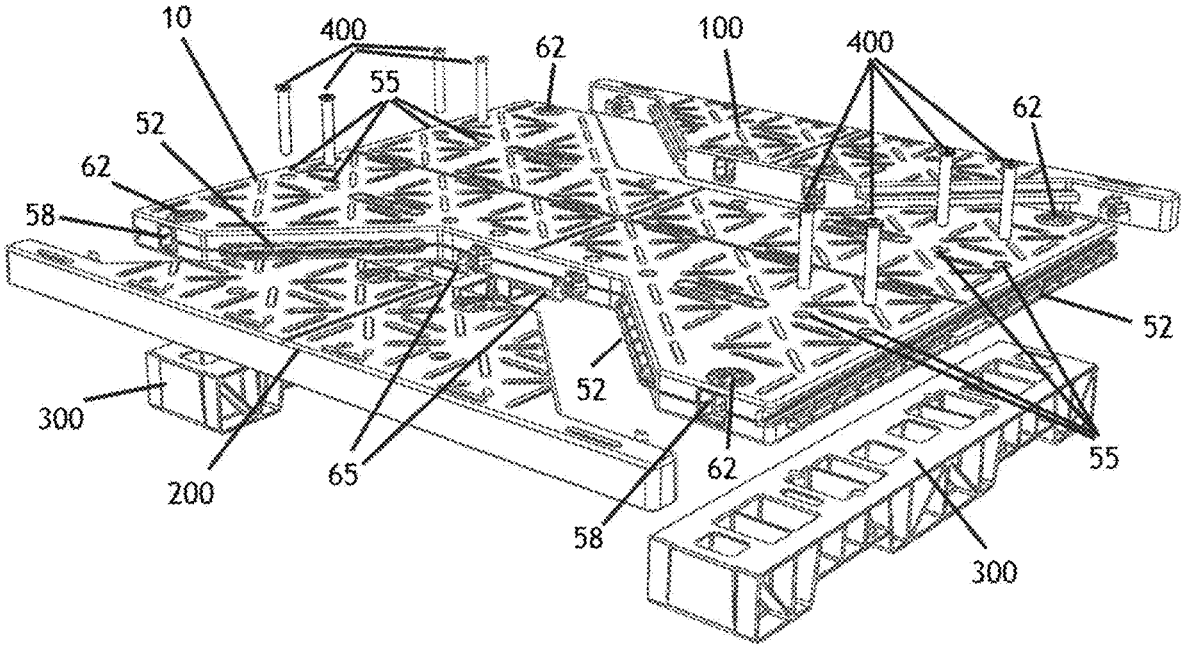
FIG. 2 is a perspective exploded view of a multi-use pallet, according to multiple embodiments and alternatives.

As disclosed in more detail below, the main body member 10, the male wing member 100, and the female wing member 200 interconnect and secure to one another via corresponding ribs and receiving slots, fingers and receiving notches, and locking mechanisms. In certain embodiments, the risers 300 are secured to the multi-use pallet 5 by bolts and nuts. FIGS. 1-2 show an exploded view of the multi-use pallet components and best illustrate how male wing member 100 and female wing member 200 connect and secure to main body member 10. FIGS. 1-2 and FIGS. 5-8 also illustrate how bolts 400 can be used to secure risers 300 to main body member 10. The various Figures also illustrate how the top and bottom surfaces of the main body member 10, the male wing member 100, and the female wing member 200 consist of various patterns which increase the friction of the surfaces to aid in the transportation and handling of goods, as well increase the utility of the multi-use pallet when re-assembled into other configurations. A variety of surface patterns may be used to increase the friction of these surfaces.

In FIG. 1, four dashed lines, lettered A, B, C, and D, are drawn to illustrate the various components of the main body member 10. In some embodiments, main body member 10 comprises central section 22 located between dashed lines B and C, and end sections 30 located outside of dashed lines B and C. The central section 22 is a square or rectangular shape, and the end sections 30 comprise an isosceles trapezoid section 32 integrally connected to rectangular section 42 (i.e. running along dashed lines A and D). Accordingly, end sections 30 comprise an irregular hexagon form. The central section 22 consists of external sides 25 and end lengths 28. The isosceles trapezoid section 32 of end section 30 consists of a long length 35 and a short length 38, and a pair of external oblique lengths 40. The long length 35 is parallel to short length 38. The rectangular section 42 of the end section 30 consists of a pair of parallel short lengths 45 (which are external to the main body member), an internal long length 48, and an external long length 50. The short length 38 of isosceles trapezoid section 32 is integrally connected to the end length 28 of central section 22 (i.e. running along dashed lines B and C), and the long length 35 of isosceles trapezoid section 32 is integrally connected to internal long length 48 of the rectangular section 42 (i.e. running along dashed lines A and D).

Figure 9:
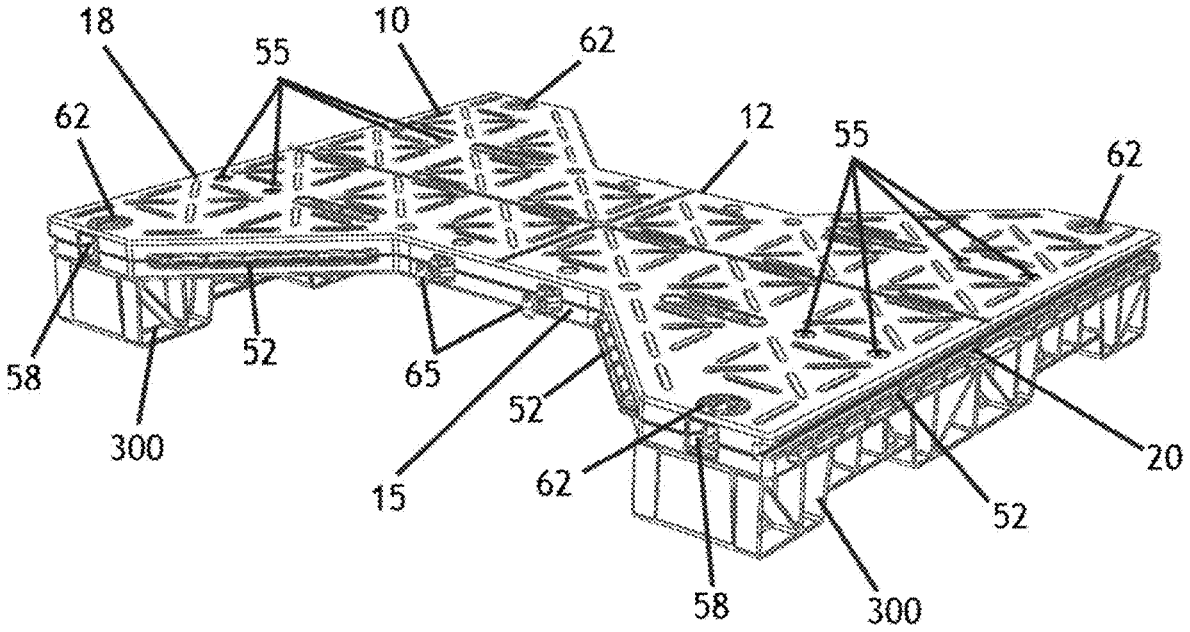
FIG. 9 is a perspective view of a multi-use pallet without wing members, according to multiple embodiments and alternatives.
Figure 10:
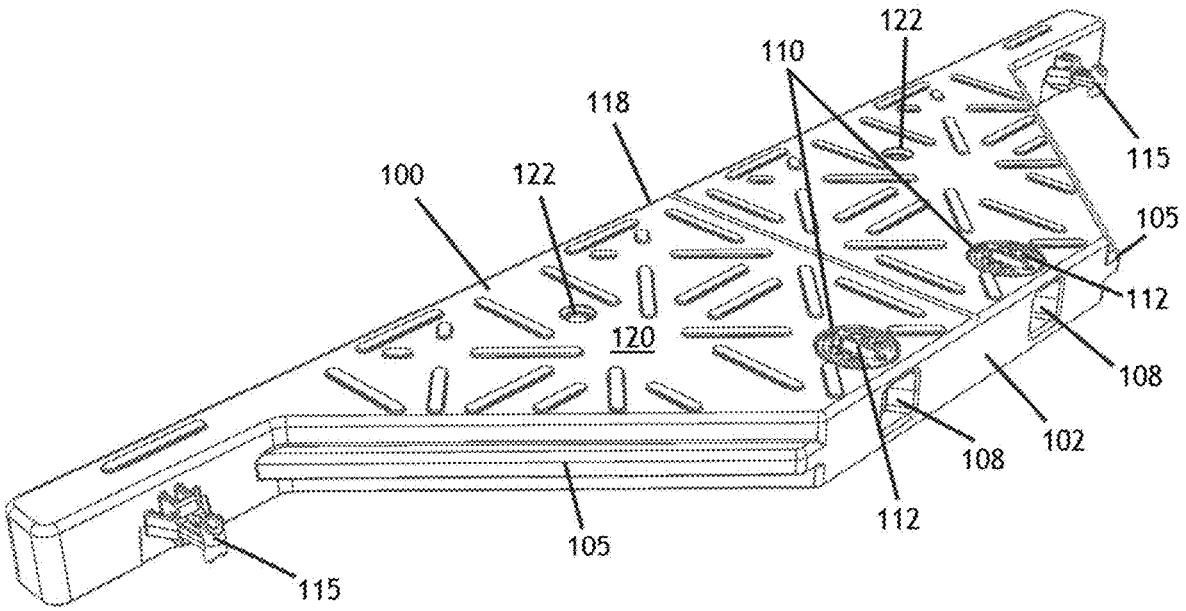
FIG. 10 is a perspective top view of a male wing member, according to multiple embodiments and alternatives.
Figure 11:
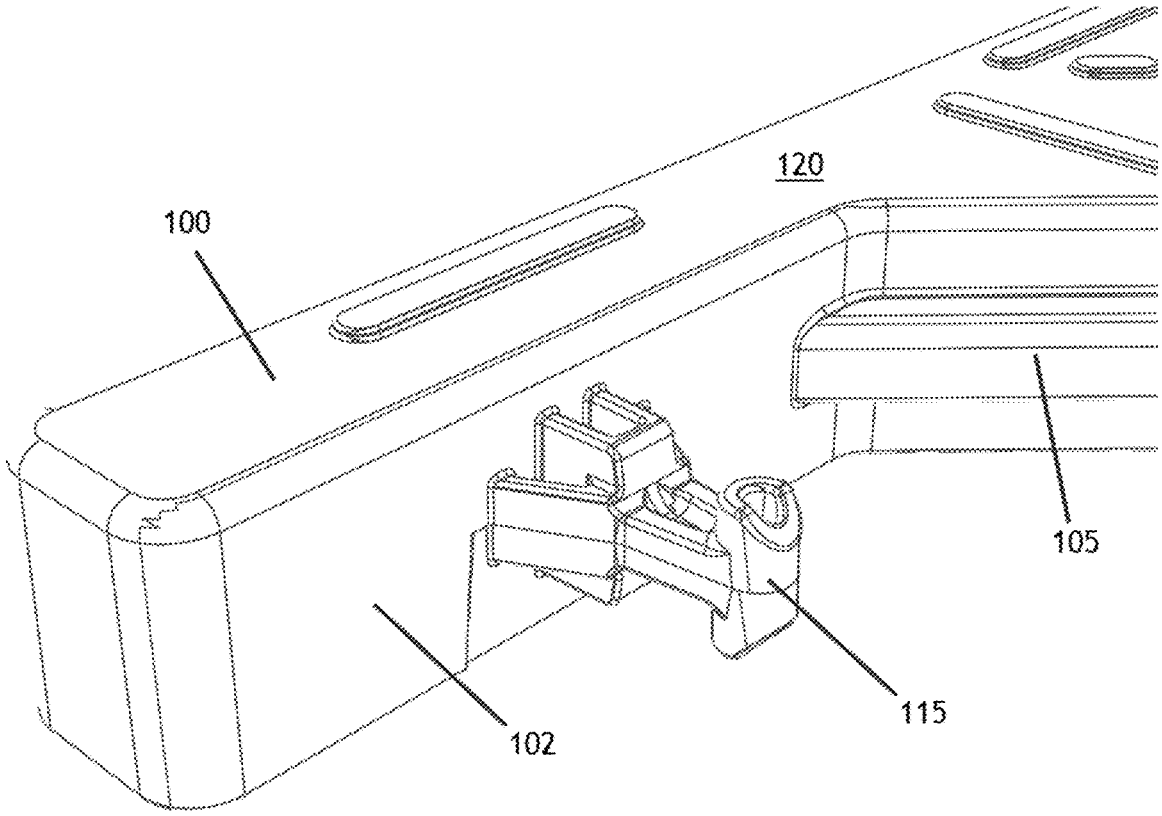
FIG. 11 is a close up, perspective, and top view of a male wing member, according to multiple embodiments and alternatives.

In some embodiments, the main body member 10 consists of a first side 12, a second side 15, as well as a first end 18 and a second end 20. As best illustrated in FIGS. 1-2 and FIG. 9, first side 12 is configured to receive, connect, and secure to male wing member 100, while second side 15 is configured to engage, connect, and secure to female wing member 200. According to present embodiments, the main body member 10 comprises identical top and bottom surfaces. As such, the main body member may be utilized as a pallet or re-assembled into other configurations disclosed herein regardless of its orientation.

In present embodiments, certain sides of the main body member, the male wing member, and the female wing member include fingers that are received in one or more corresponding notches which are adapted to receive each projection. The different sides of these components also include ribs and corresponding slots. FIGS. 1-2 and FIGS. 7-9 best illustrate the fingers, notches, slot and ribs with respect to the main body member 10. In certain embodiments, the central section 22 consists of fingers 65 which extend outward. Fingers 65 can either be integral to the main body member 10, are separately connected. The external short lengths 45 of rectangular section 42 also include notches 58 that are adapted to receive fingers from other wing members, as well as the fingers 65 of other main body members 10. As disclosed herein, the interconnectivity of the various components of the multi-use pallet results in variety of configurations (in addition to a pallet) that are advantageous to the user and those in the industry.

The external oblique lengths 40, located on the second side 15 of the main body member, include ribs 52 that are configured to engage corresponding slots 205 located on female wing member 200 and to engage corresponding slots 53 on the second side 15 of other main body members. On the other hand, the external oblique lengths 40 located on the first side 12 of the main body member, include slots 53 that are adapted to receive corresponding ribs 105 located on male wing member 100 and are also adapted to receive corresponding ribs 52 located on the second side 15 of other main body members. In some embodiments, second end 20 of main body member includes ribs 52 that are configured to engage corresponding slots 53 located on the first end 18 of other main body members.

In some embodiments, the fingers are secured to the corresponding notches by the use of a locking mechanism. While any type of locking mechanism will be suitable to one of ordinary skill in the art, the current embodiments provide for a locking mechanism comprising a rotatable lock member that is positioned in a bore positioned adjacent to the receiving notch. Upon insertion of a finger into a receiving notch, the locking mechanism is rotated about the bore to secure the finger in place. To remove the finger from the notch, the locking mechanism is rotated back to its starting position and the finger can then be removed.

Figure 8:
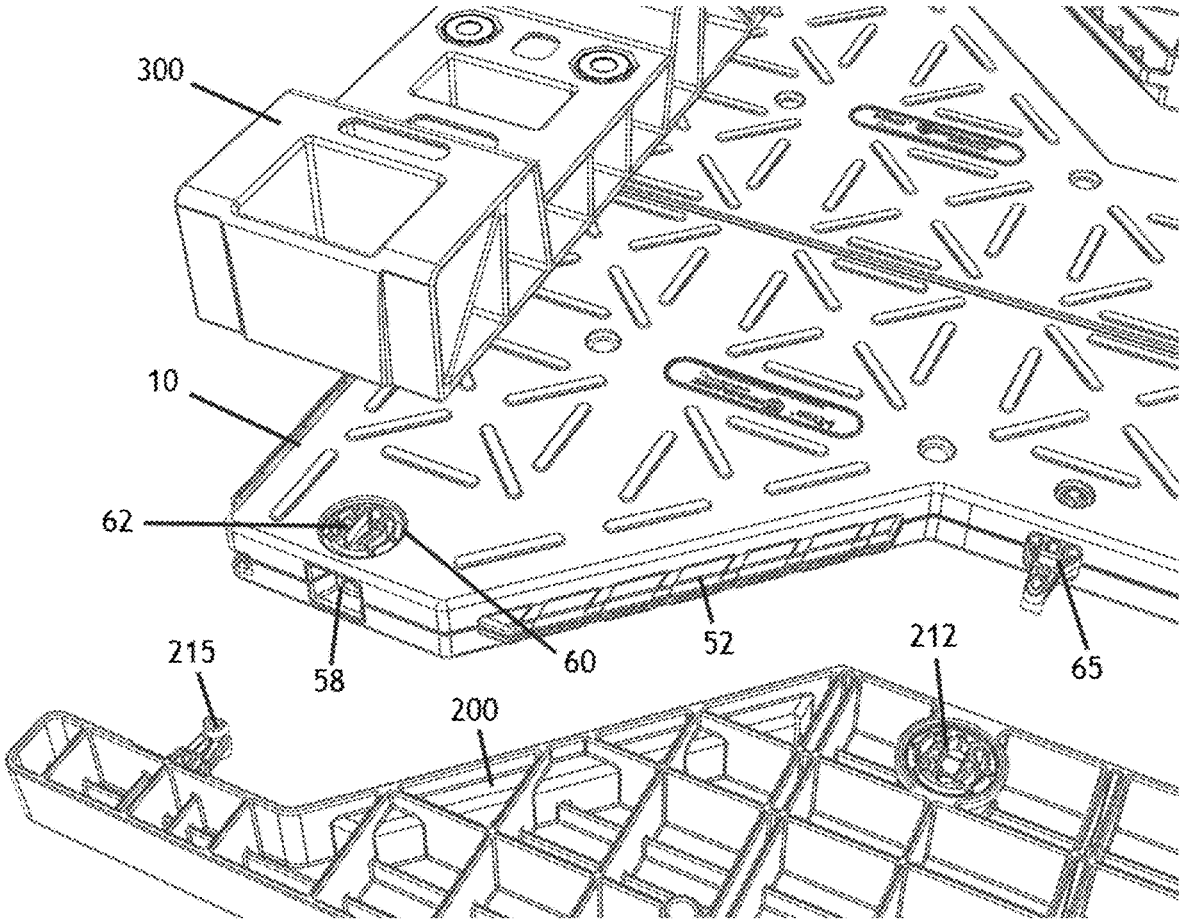
FIG. 8 is close-up, perspective, and bottom view of a multi-use pallet, according to multiple embodiments and alternatives.

FIG. 8 best illustrates the locking mechanism 62 of the main body member 10. As shown in this figure, a bore 60 is located adjacent and perpendicular to notch 58 (which is adapted to receive a finger from another component). The locking mechanism 62 is then positioned into an open, receiving position within bore 60. Upon insertion of finger 215 of female wing member 200 into notch 58, the locking mechanism is rotated within bore 60 until the finger is secured in place.

When a pallet is elevated above the floor, it can be more easily handled and moved by machinery such as forklifts, a jack, a crane, etc. Accordingly, the multi-use pallet of current embodiments is elevated above the floor by a pair of risers 300. In current embodiments, the risers are secured to the main body member 10 by a series of bolts 400 and nuts 402. To attach the risers, the bolt receiving holes 55 of main body member 10 must first align with the bolt receiving holes 312 of risers 300. Once aligned, the bolts 400 can be inserted through the main body member, and through the risers until the bolts extend out of the bottom of the risers. Then, the bolts 400 are secured with nuts 402.

As illustrated in FIGS. 10-14, the male wing member 100 comprises an internal side 102 and an external side 118. As disclosed herein, the internal side 102 is configured to engage and secure to the main body member 10, as well a female wing member 200. The internal side 102 consists of a number of features to attach to other components such as ribs 105, fingers 115, and notches 108. The fingers 115 are configured to be inserted into notches 58 located on the main body member 10 or female wing members 200, as chosen by the user. In addition, the notches 108 are adapted to receive the fingers 65 of the main body member 10 or the fingers 215 of the female wing member 200. The ribs 105 of the male wing member 100 engage with corresponding slots 53 located on the first side 12 of the main body member 10, or slots 205 located on the internal side 202 of the female wing member 200. According to present embodiments, the male wing member 100 is distinguished from the female wing member 200 only by the presence of ribs 105 on internal side 102, while the female wing member 200 has a corresponding slot 205 on its internal side 202.

Figure 35:
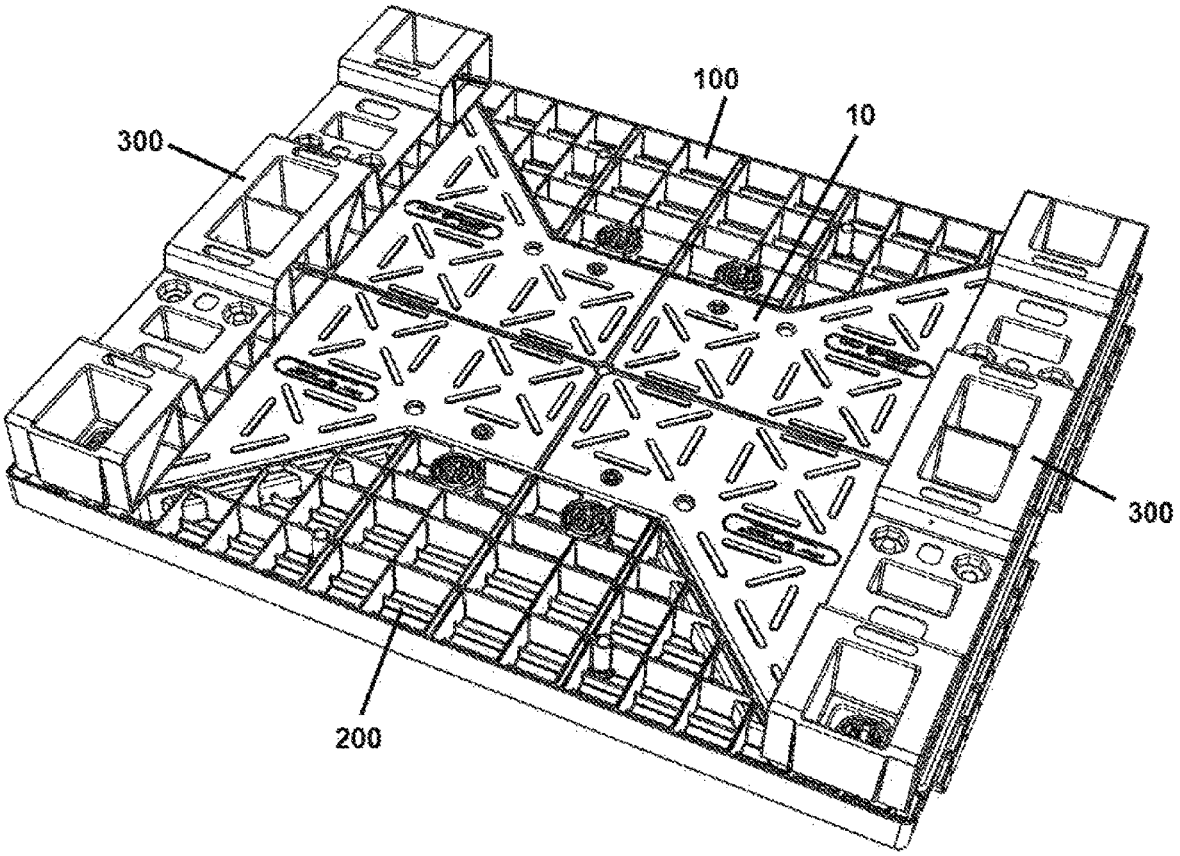
FIG. 35 is a perspective bottom view of a multi-use pallet, according to multiple embodiments and alternatives.

Male wing member 100 also includes bore 110 which is adapted to receive the locking mechanisms 112. As previously discussed, after insertion of the fingers into the notches 108, the locking mechanisms 112 are rotated about the bore to secure the fingers into place. To remove the fingers, the locking mechanism can be rotated back to the open position and the fingers can be removed. Male wing member 100 also includes a top surface 120 that consists of a patterned surface to give the male wing member 100 non-slip characteristics. The male wing member 100 also includes a series of bolt receiving holes 122 that are adapted to receive bolts 400. As discussed in more detail below, the components of the multi-use pallets can be reassembled into a number of versatile configurations. In some arrays, it may be useful for the user to provide additional support by attaching risers 300 to the wing members 100, 200. For instance, as illustrated in FIG. 35, the length of the risers 300 is suitable to span the length of the main body member 10, and the wing members 100, 200. Accordingly, the bolt receiving holes 122 in the male wing member 100 provide the user the flexibility to attach risers 300 to the bottom 125 of the male wing member 100.

Figure 13:
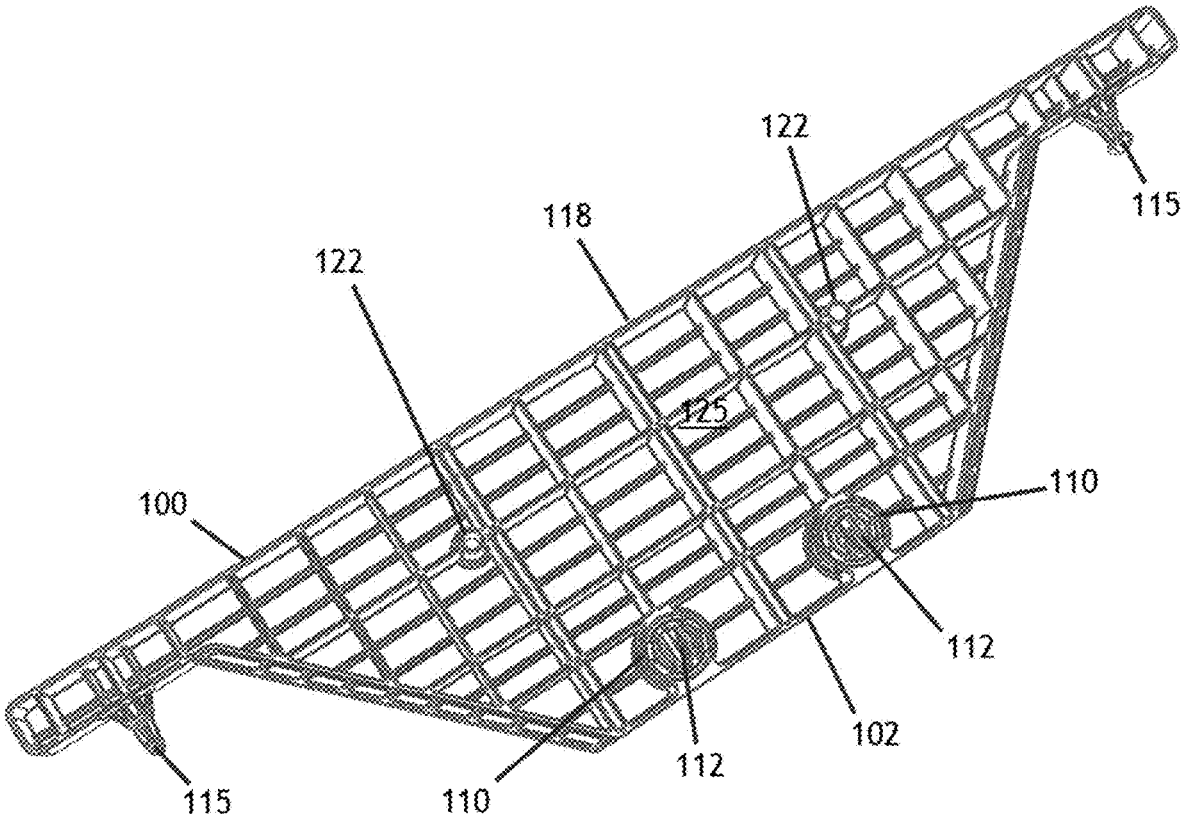
FIG. 13 is a perspective bottom view of a male wing member, according to multiple embodiments and alternatives.
Figure 14:
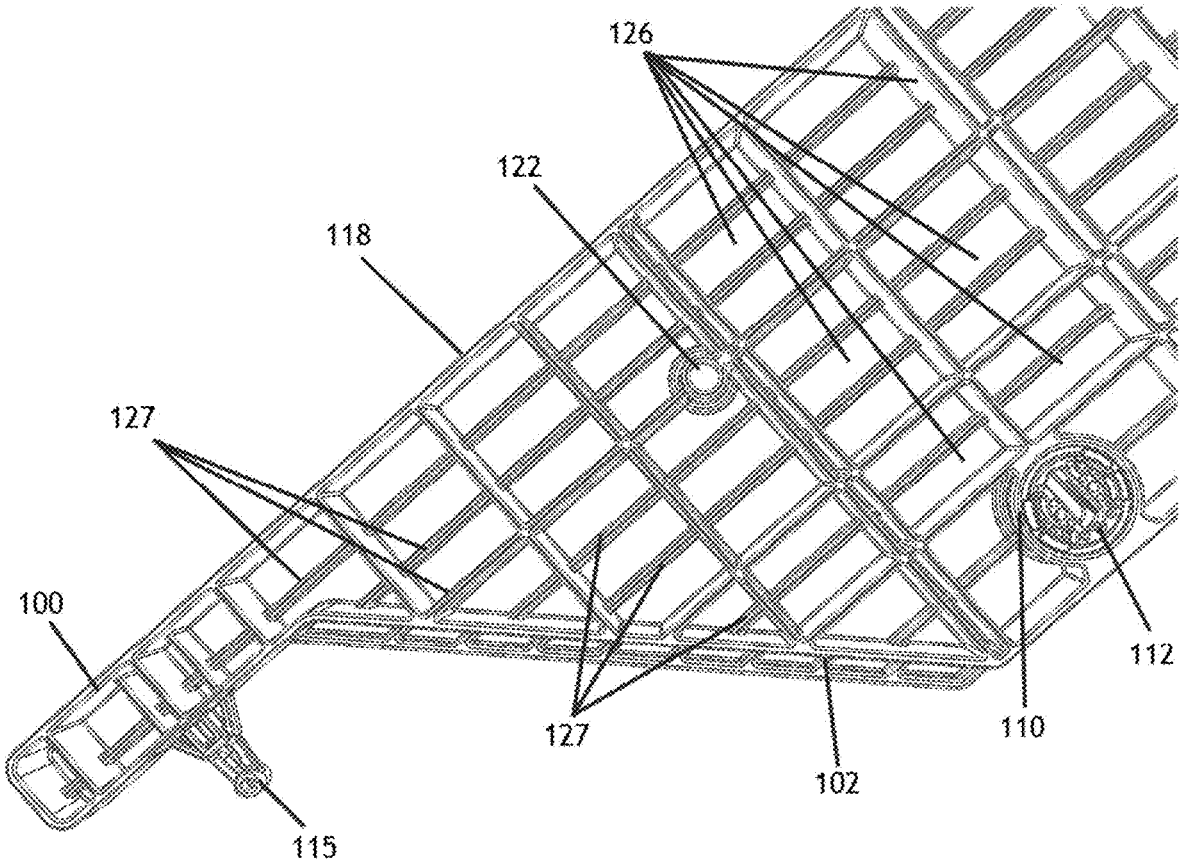
FIG. 14 is a close-up, perspective and bottom view of a male wing member, according to multiple embodiments and alternatives.

As best illustrated in FIGS. 13-14, the male wing member 100 also includes a bottom surface 125 consisting of a reinforcing structure that provides greater structural support to the male wing member. According to present embodiments, the bottom surface 125 consists of a series of spines 127 and a series of reinforcing cells 126, which together form a reinforcing grid structure. A variety of reinforcing structures may be utilized in the bottom surface 125 to impart sufficient strength and load-bearing support to the male wing member. FIGS. 13-14 also illustrate the bolt receiving holes 122 passing completely through the male wing member and illustrate bore 110 that is adapted to receive lock mechanism 112.

Figure 12:
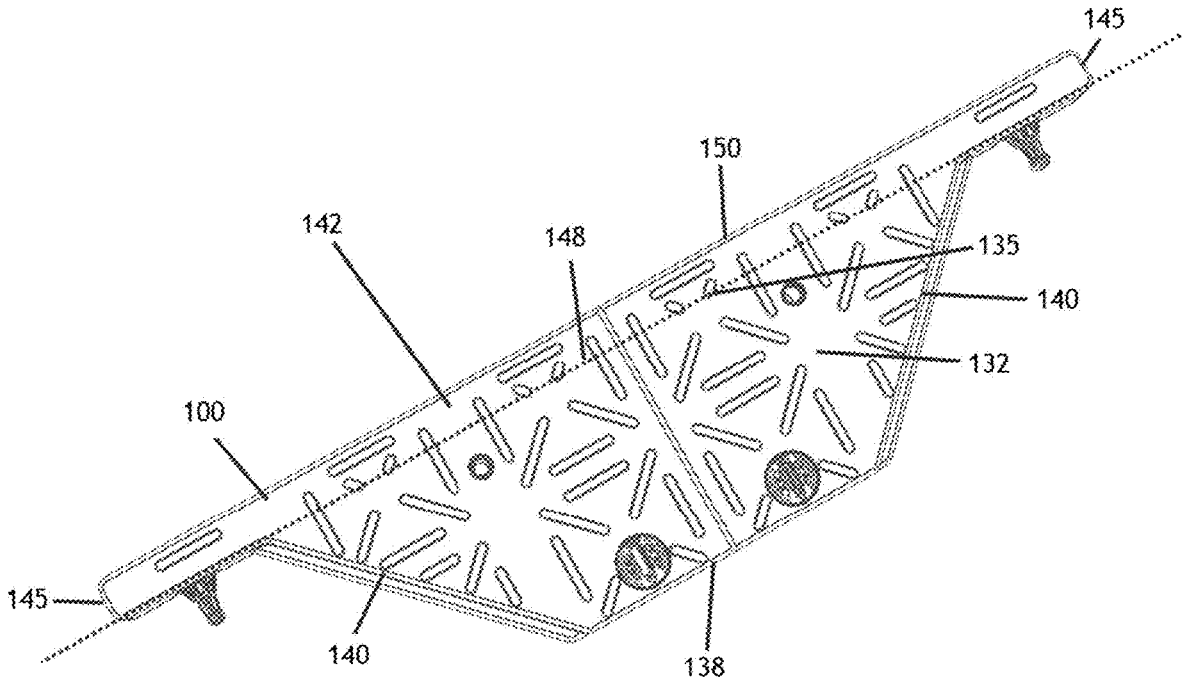
FIG. 12 is a plan view of a male wing member, according to multiple embodiments and alternatives.

FIG. 12 illustrates the isosceles trapezoid part 132 and the rectangular part 142 of the male wing member 100. The isosceles trapezoid part 132 consists of a pair of external oblique lengths 140, a short length 138, and a long length 135. In current embodiments, the short length 138 is parallel to long length 135. The rectangular part 142 consists of a pair of parallel, external short lengths 145, an internal long length 148 and an external long length 150. The internal and external long lengths are parallel. Further, the internal long length 148 of the rectangular part 142 is integrally connected to the long length 135 of the isosceles trapezoid part 132.

Figure 15:
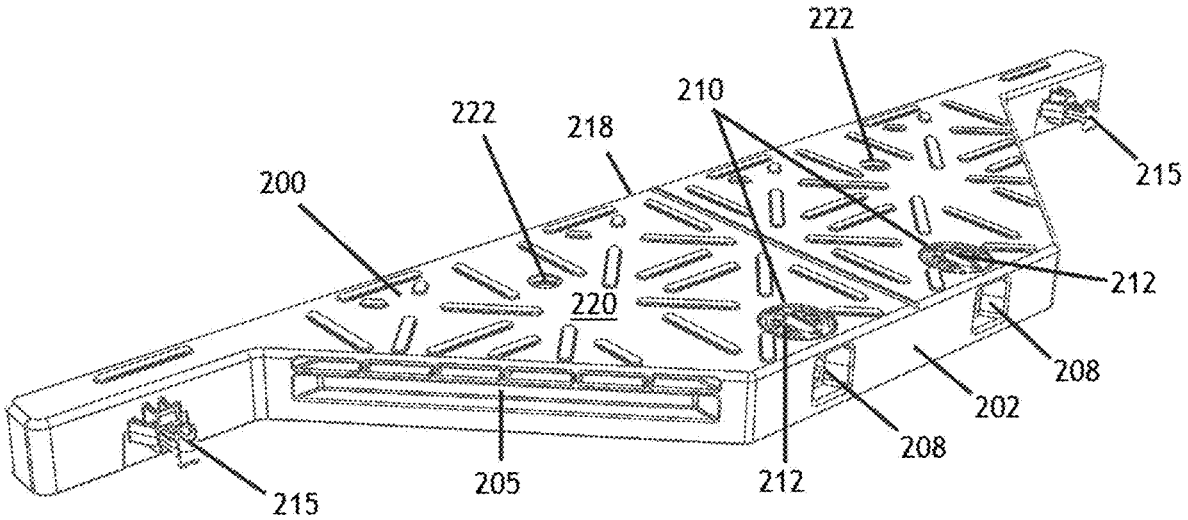
FIG. 15 is a perspective top view of a female wing member, according to multiple embodiments and alternatives.
Figure 16:
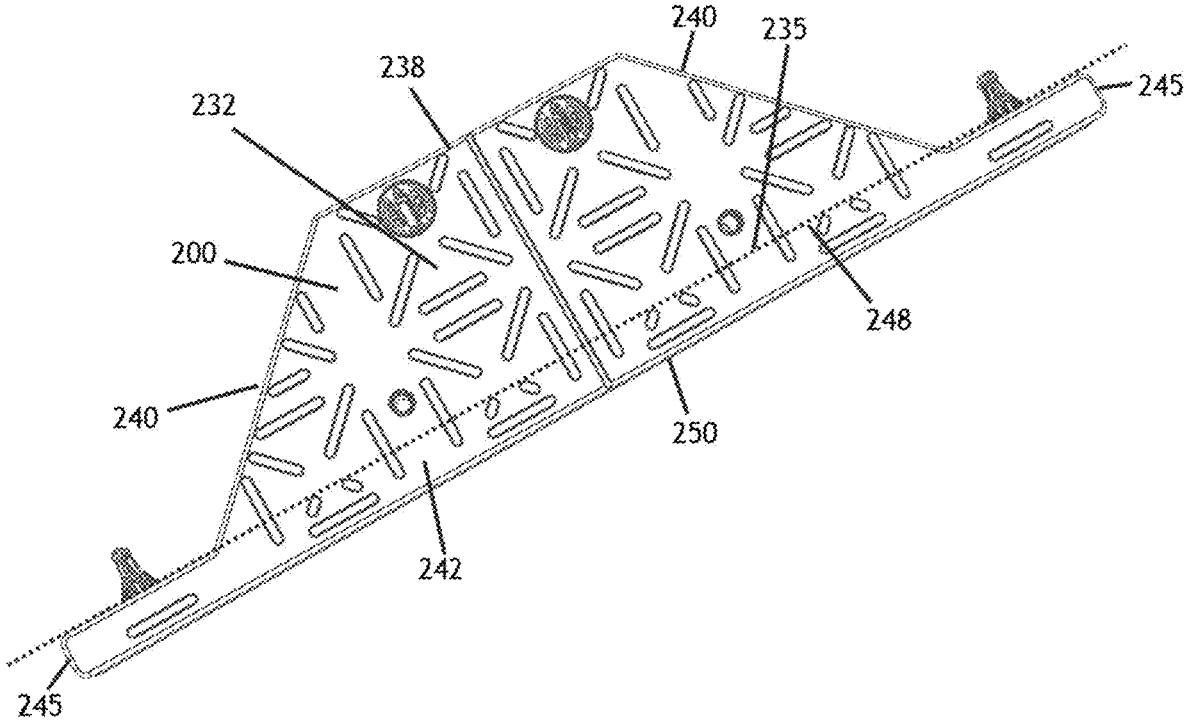
FIG. 16 is a plan view of a female wing member, according to multiple embodiments and alternatives.
Figure 17:
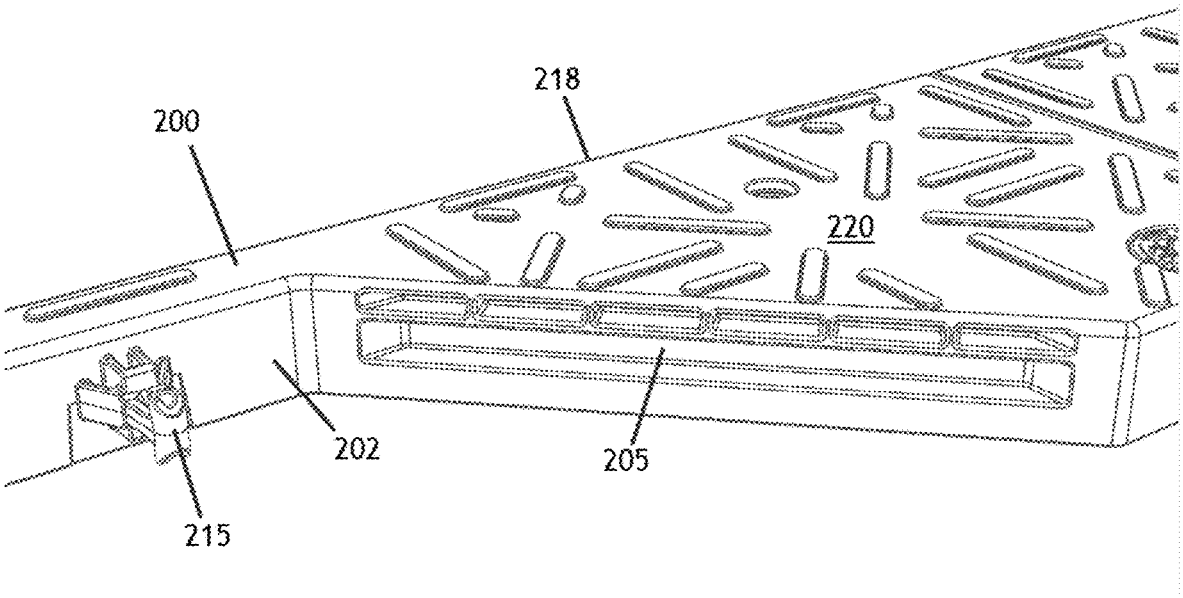
FIG. 17 is a close-up, perspective and top view of a female wing member, according to multiple embodiments and alternatives.
Figure 18:
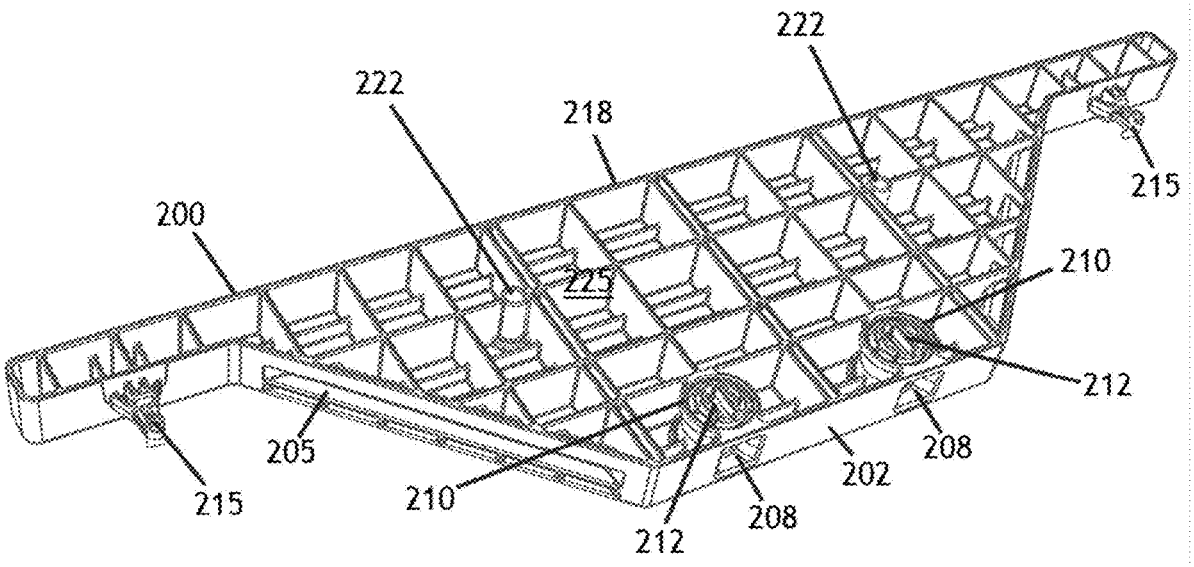
FIG. 18 is a perspective bottom view of a female wing member, according to multiple embodiments and alternatives.

FIGS. 15-19 provide various views of female wing member 200. As previously noted, the only difference between the male and female wing members is that the male wing members include ribs 105 on the internal side 102 and the female wing members include slots 205 on the internal side 202 that are configured to receive the ribs of the main body member or male wing members. Likewise, the only difference between the male corner members 101 and female corner members 201 (discussed in further detail below) is that the male corner members include ribs 52 on the internal side and the female corner members include slots 205 on the internal side. FIGS. 15, 17 and 18 show the internal side 202 and external side 218 of the female wing member 200. The internal side 202 includes fingers 215, slots 205, and notches 208. The fingers 215 are inserted into corresponding slots located on the main body member or the male wing members. The slots 205 are adapted to receive corresponding ribs located on the main body member and the internal side of the male wing member. The notches 208 are adapted to receive the fingers from the main body member and the male wing members. The female wing member also includes bores 210 that are positioned adjacent and perpendicular to the notches 208. The bores are adapted to receive the locking mechanisms 212. Upon insertion of a finger into a notch 208, the locking mechanism 212 is rotated within the bore into a closed position, which locks the finger in place. To remove the finger, the locking mechanism is rotated within the bore 210 into an open position.

The female wing member 200 includes a top surface 220 that consists of a pattern designed to give the top surface non-slip characteristics. The female wing member 200 also includes bolt receiving holes 222 which are adapted to receive bolts 400 and can be used to attach a riser 300 to a female wing member 200. The bolt receiving holes allow the female wing member to be re-arranged into a number of arrays and configurations as needed by the user.

Figure 19:
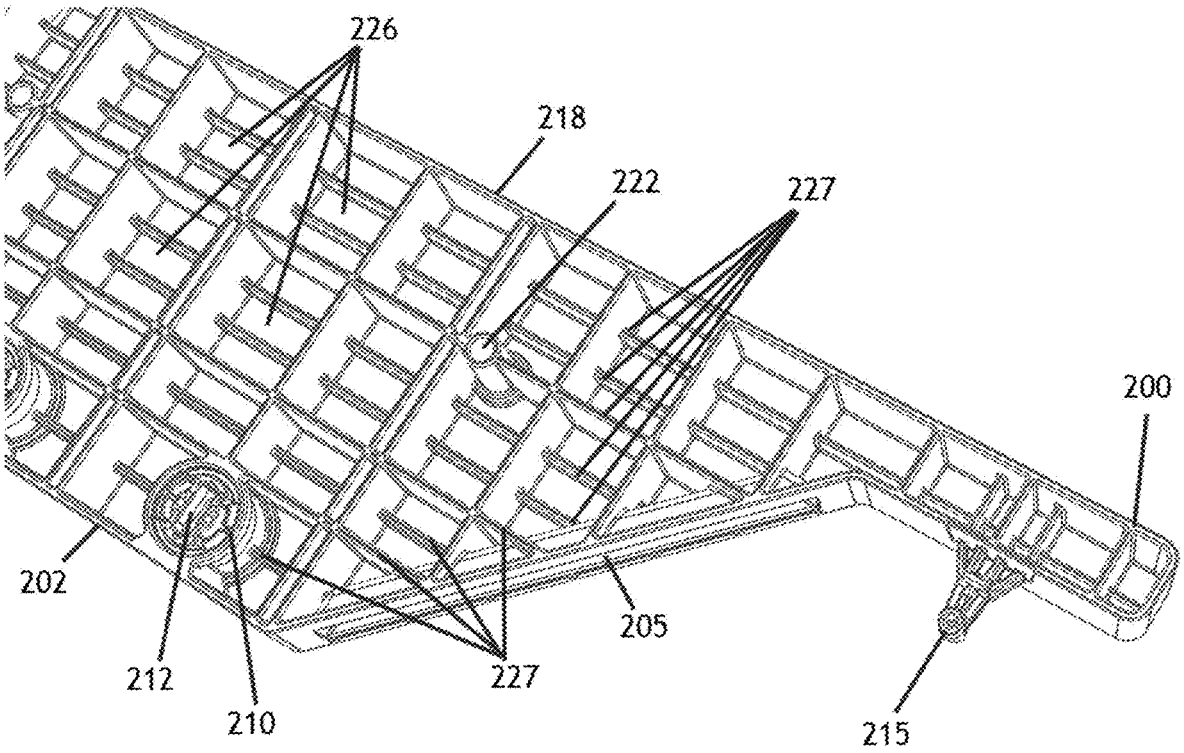
FIG. 19 is a close-up, perspective, and bottom view of a female wing member, according to multiple embodiments and alternatives.
Figure 20:
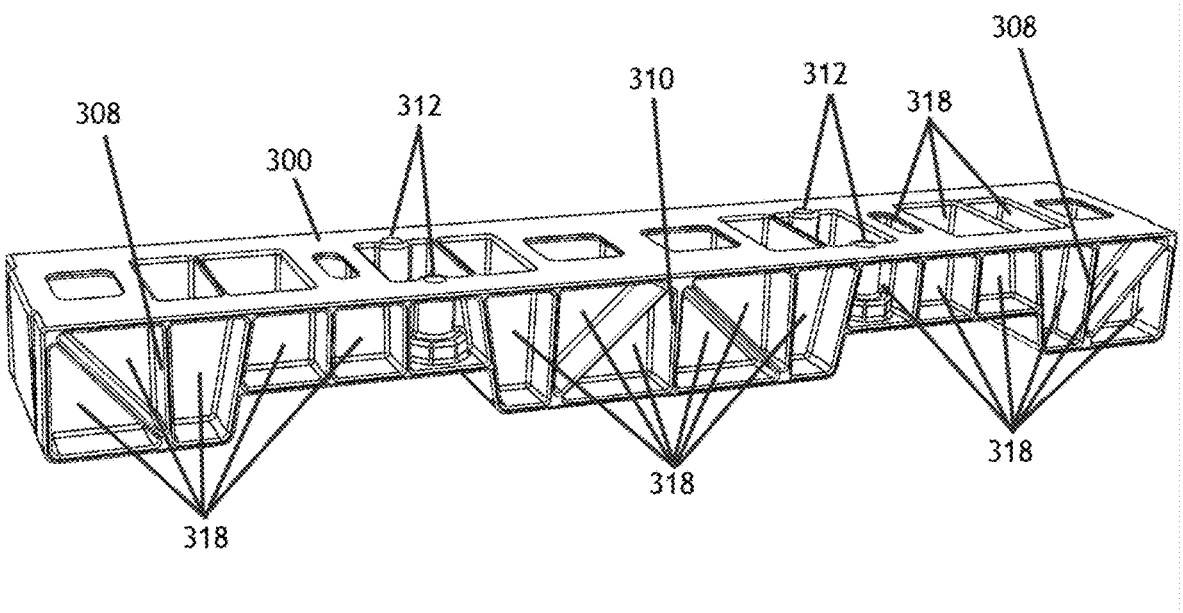
FIG. 20 is a perspective top view of a riser, according to multiple embodiments and alternatives.

FIGS. 18-19 illustrate the bottom surface 225 of female wing member 200. As best shown in FIG. 19, the bottom surface 225 comprises a series of spines 227 and a series of reinforcing cells 226, which form a reinforcing grid pattern beneath the female wing member. The spines 227 and the reinforcing cells 226 provide greater structural strength and load-bearing potential for the female wing member. Furthermore, the bolt receiving holes 222 pass completely through the female wing member and bore 210 is adapted to receive lock mechanism 112.

FIG. 16 illustrates the isosceles trapezoid part 232 and the rectangular part 242 of the female wing member 200. The isosceles trapezoid part 232 consists of a pair of external oblique lengths 240, a short length 238, and a long length 235. In current embodiments, the short length 238 is parallel to long length 235. The rectangular part 242 consists of a pair of parallel, external short lengths 245, an internal long length 248 and an external long length 250. The internal and external long lengths are parallel. Further, the internal long length 248 of the rectangular part 242 is integrally connected to the long length 235 of the isosceles trapezoid part 232.

Figure 21:
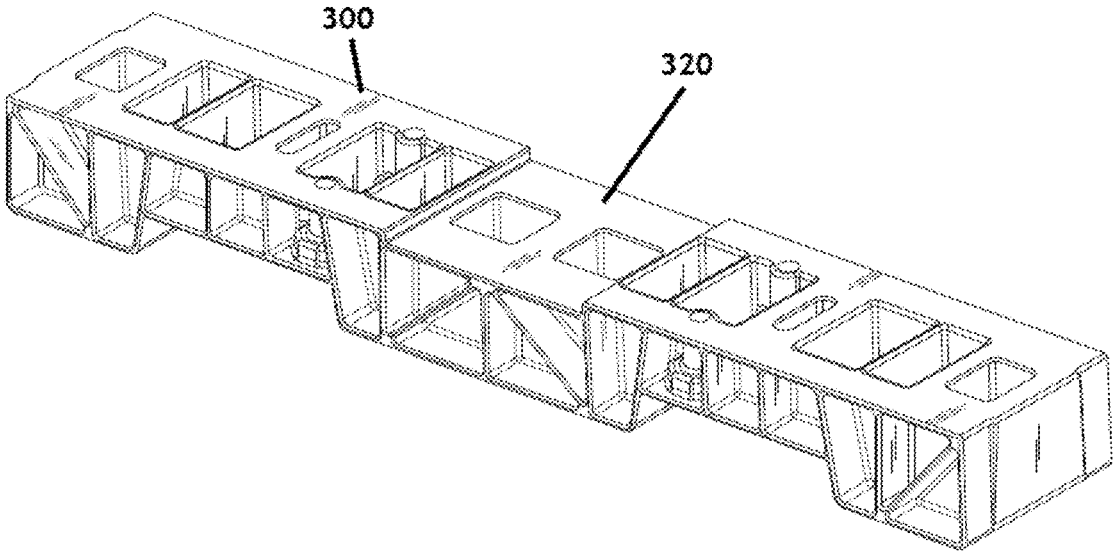
FIG. 21 is a perspective top view of a riser with a step, according to multiple embodiments and alternatives.
Figure 22:
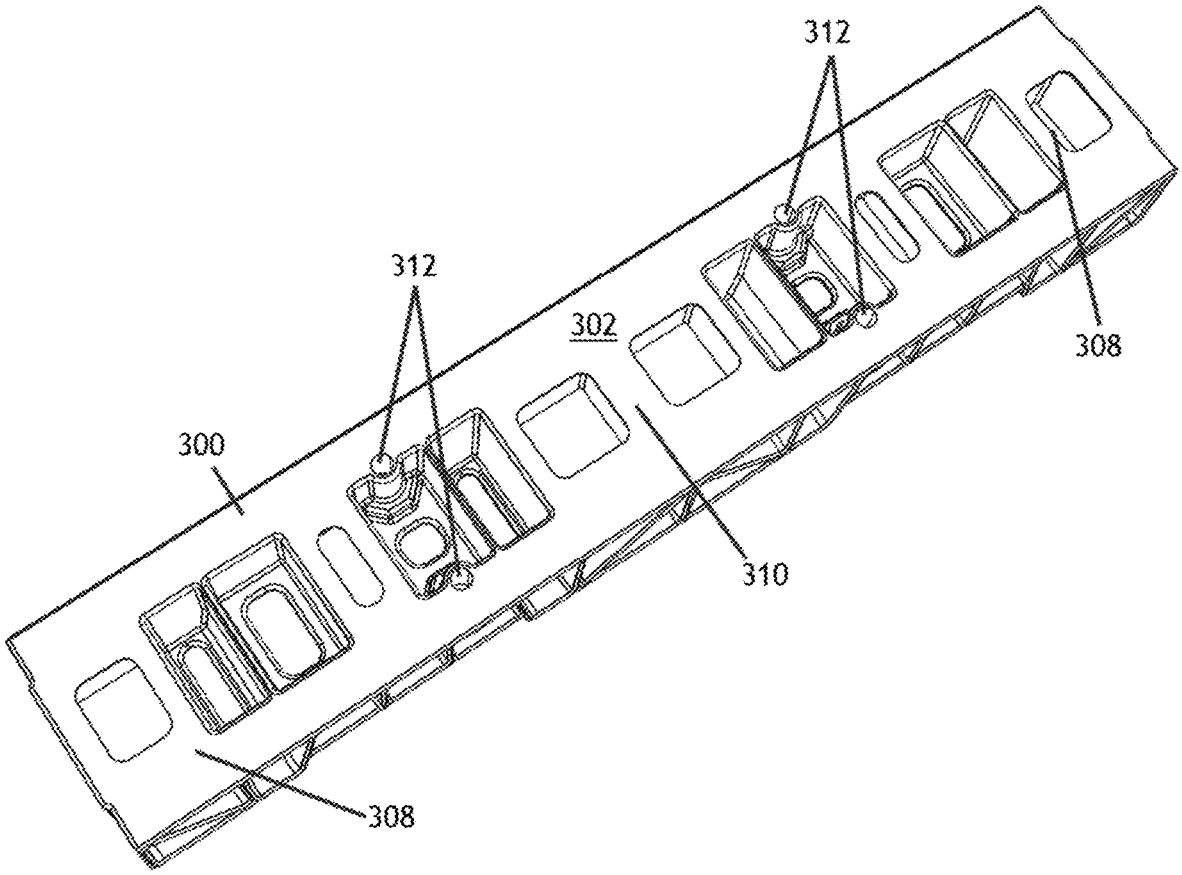
FIG. 22 is a perspective top view of a riser, according to multiple embodiments and alternatives.

As shown in FIGS. 20-24, the riser 300 consists of end sections 308 and middle section 310. As shown in FIG. 21, in some embodiments riser 300 includes step 320 to allow strapping to pass through. As illustrated in FIG. 22, the riser 300 comprises a top surface 302 and a series of bolt receiving holes 312. The riser 300 also includes a series of internal cells 318 which increase the structural support for the riser. As known by those of ordinary skill in the art, various configurations and shapes may be used to create the internal cells 318.

Figure 23:
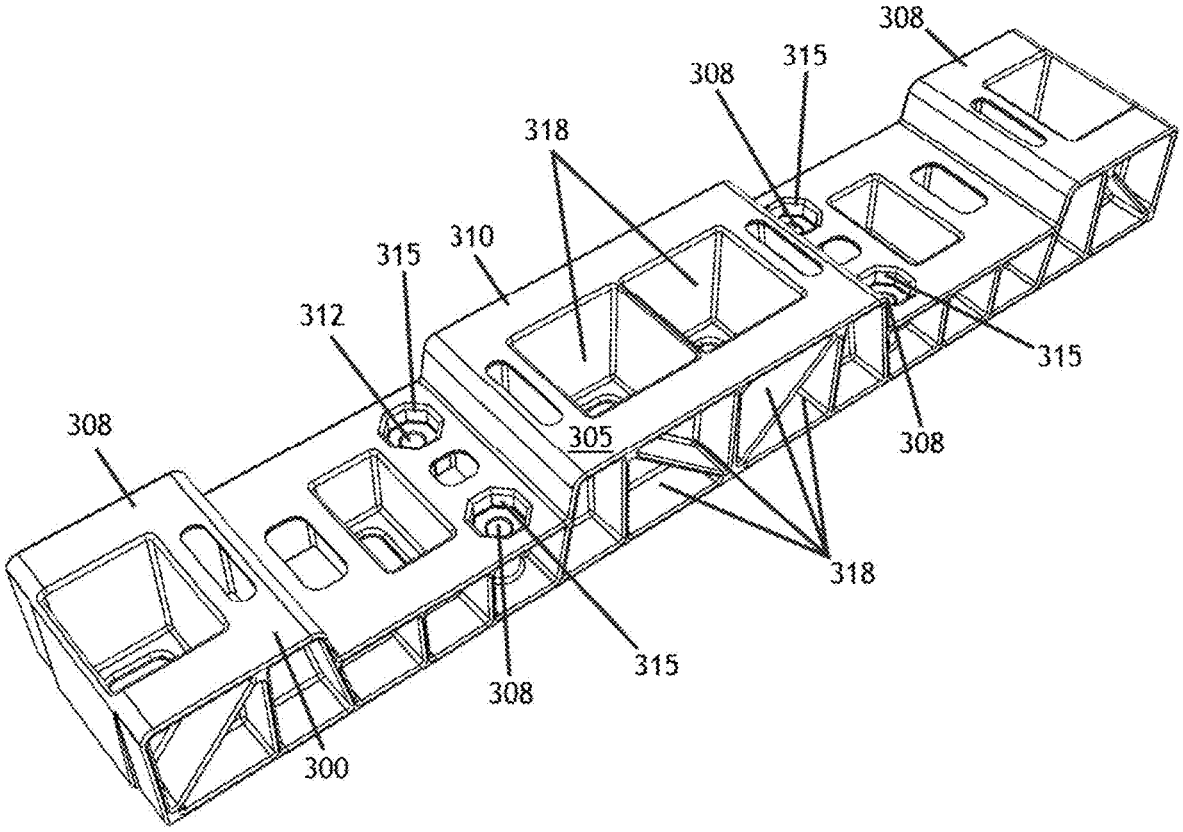
FIG. 23 is a perspective bottom view of a riser, according to multiple embodiments and alternatives.
Figure 24:
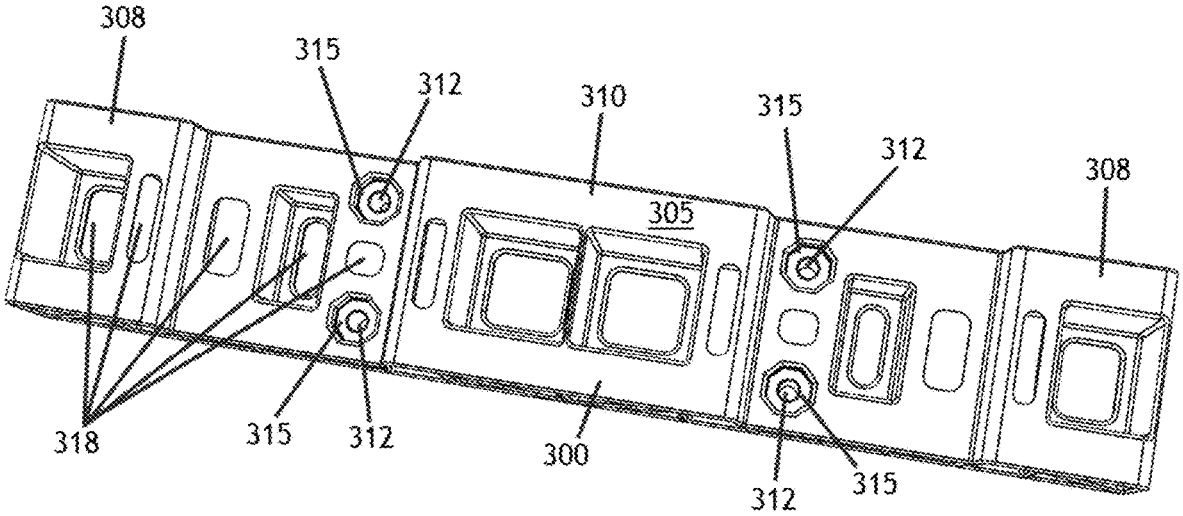
FIG. 24 is a perspective bottom view of a riser, according to multiple embodiments and alternatives.

FIG. 23 illustrates the bottom surface 305 of riser 300. This view shows the bolt receiving holes 312 passing completely through the width of riser 300. In addition, the bottom of riser 300 includes nut receiving holes 315 that are adapted to receive the nuts 402. To attach a riser to a main body member 10, a male wing member 100, or a female wing member 200, the bolt receiving holes 312 must first be aligned with the bolt receiving holes of the other component. Once these holes are aligned, a bolt 400 can be inserted into the aligned bolt receiving holes until the bolt passes completely through both components. To secure the riser in place, the nuts 402 are then inserted over the bolt 400 and rotated until the nuts engage the nut receiving hole 315.

In operation, the main body member 10, the male wing member 100, the female wing member 200, and the risers 300, can be attached to one another to form the assembled multi-use pallet 5 (best illustrated in FIGS. 3-4). In this configuration, the internal side 102 of the male wing member 100 engages with the first side of the main body member 10, the internal side 202 of the female wing member 200 engages with the second side of the main body member 10, and a pair of risers 300 are attached to the main body 10 by the use of bolts 400 and nuts 402.

In addition to the assembled multi-use pallet 5, the main body members, the wing members, the risers, the half main body members, and the corner members can be re-arranged into a variety of other configurations that may be useful for other purposes such as elevated flooring, walkways, roadways, and so forth. These different configurations are illustrated in FIGS. 25-32.

In operation, the main body member, the wing members, and the risers can also be assembled into a generally rectangular pad 6, which comprises a pair of opposing sides. As shown in FIG. 26, the first pair has a first side 90 and a second side 92 wherein the first side has a length defined by a plurality of male wing members 100 and a male corner member 101. The second side 92 has a length defined by a plurality of female wing members 200 and a female corner member 201. The second pair of opposing sides has a first end 95 and a second end 98, wherein the first end 95 has a length defined by the male corner member 101, a plurality of main body members 10, and a plurality of half main body members 11. The second end 98 has a length defined by the female corner member 201, a plurality of main body members 10, and a plurality of half main body members 11. To assemble the rectangular pad 6 illustrated in FIGS. 25-28, the first sides 12 of the main body member are attached to the second sides 15 of other body members, and the first ends 18 are attached to the second ends 20 of other body members.

To attach the main body members to one another, the ribs 52 on the first sides 12 must engage with the slots 53 on the second sides 15 of other main body members, and the ribs 52 on the second ends 20 must engage with the corresponding slots 53 on the first ends 18. In addition, the fingers 65 must be inserted into the notches 58, and can be secured into place by rotating the locking mechanisms 62 within the bores 60. The user can secure as many main body members 10 together as needed, to expand the first side 90 and the second side 92, and/or expand the first end 95 and the second end 98, to create a pad 6 of a variety of sizes. In some embodiments, the pad 6 is a rectangular or square shape.

Figure 32:
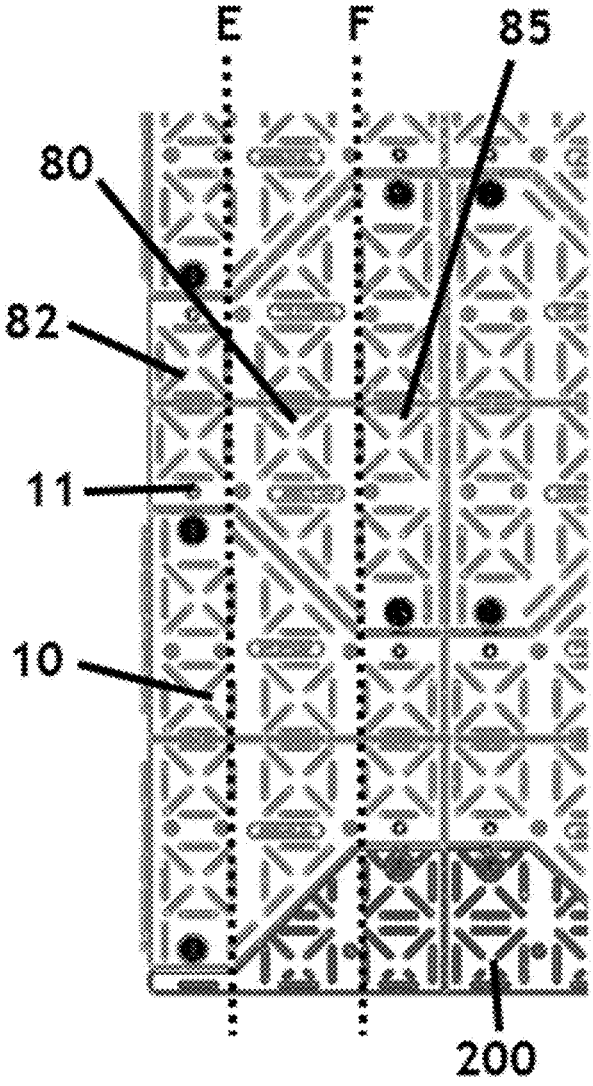
FIG. 32 is a plan view of a half main body member, according to multiple embodiments and alternatives.

To straighten the edges of an array of main body members 10, half main body members 11 (illustrated in FIG. 32) must be utilized to create a straight first end 95 and a straight second end 98. In FIG. 32, dashed lines E and F are drawn to illustrate the various components of half body members 11. According to multiple embodiments and alternatives, half body members 11 comprise a central member 80 integrally connected to a first end unit 82 and a second end unit 85. In some embodiments, the first end unit 82 has a rectangular form and the second end unit 85 has a rectangular form that is larger than the first end unit 82.

On first side 90 and second side 92 of pad 6, both male and female wing members are attached to the edges of the array, and the top surface 120 of the male wing members and the top surface 220 of the female wing members face upwards. As previously noted, the ribs 105 of male wing members 100 engage with the corresponding slots 53 on the first sides 12 of the main body members. In addition, the fingers and corresponding notches must be aligned and engage with one another. To attach the female wing members to this array, the ribs 52 located on the second side 15 of the main body member engage with the slots 205 located on the internal sides 202 of the female wing members. Also, the various fingers and corresponding notches engage one another.

Figure 33:
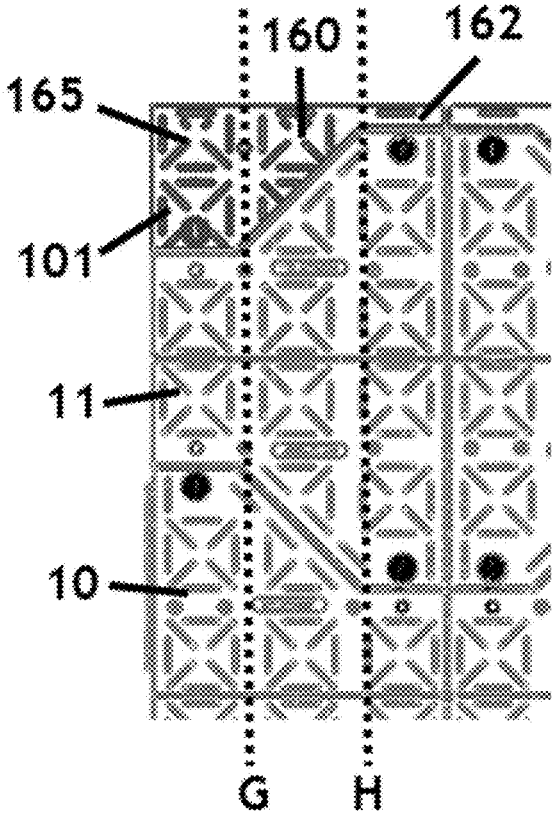
FIG. 33 is a plan view of a male corner member, according to multiple embodiments and alternatives.
Figure 34:
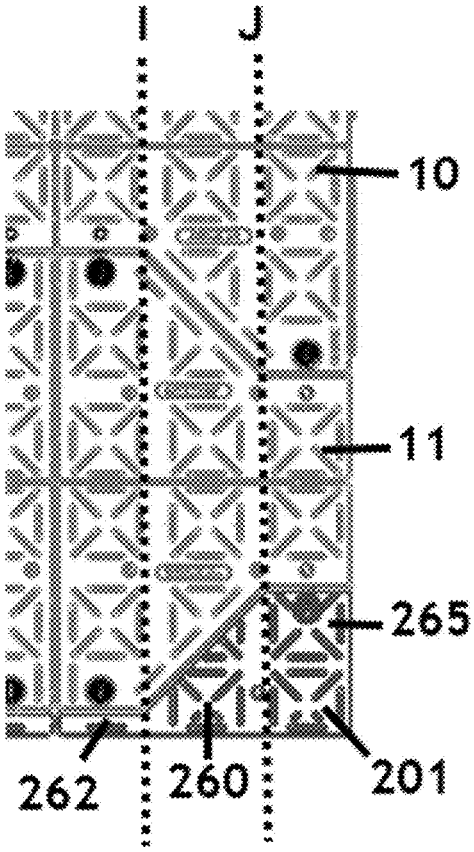
FIG. 34 is a plan view of a female corner member, according to multiple embodiments and alternatives.

Lastly, the male corner member 101 (illustrated in FIG. 33) and the female corner member 201 (illustrated in FIG. 34) are attached to the array, with the top surfaces facing upwards, to straighten the edges. In FIG. 33, dashed lines G and H are drawn to illustrate the various components of male corner member 101. According to multiple embodiments and alternatives, the male corner member 101 comprises a first a central unit 160 integrally connected to a first end 162, and a second end 165. As shown in FIG. 33, the central unit 160 has a non-isosceles trapezoid form, the first end 162 has a rectangular form, and the second end 165 has a rectangular form larger than the first end 162. In FIG. 34, dashed lines I and J are drawn to illustrate the various components of female corner member 201. According to multiple embodiments and alternatives, the female corner member 201 comprises a first a central unit 260 integrally connected to a first end 262, and a second end 265. As shown in FIG. 34, the central unit 260 has a non-isosceles trapezoid form, and the first end 262 has a rectangular form and the second end 265 has a rectangular form larger than the first end 262.

The pad 6 can be utilized for any number of purposes as needed by the user. For example, the pad illustrated in FIG. 25 can be utilized as an array of panels on the ground surface. In this situation, pad 6 could be used as flooring, a walkway, a roadway, and so forth. It will be understood that pad 6 could also be used to create walls for a structure.

Figure 25:
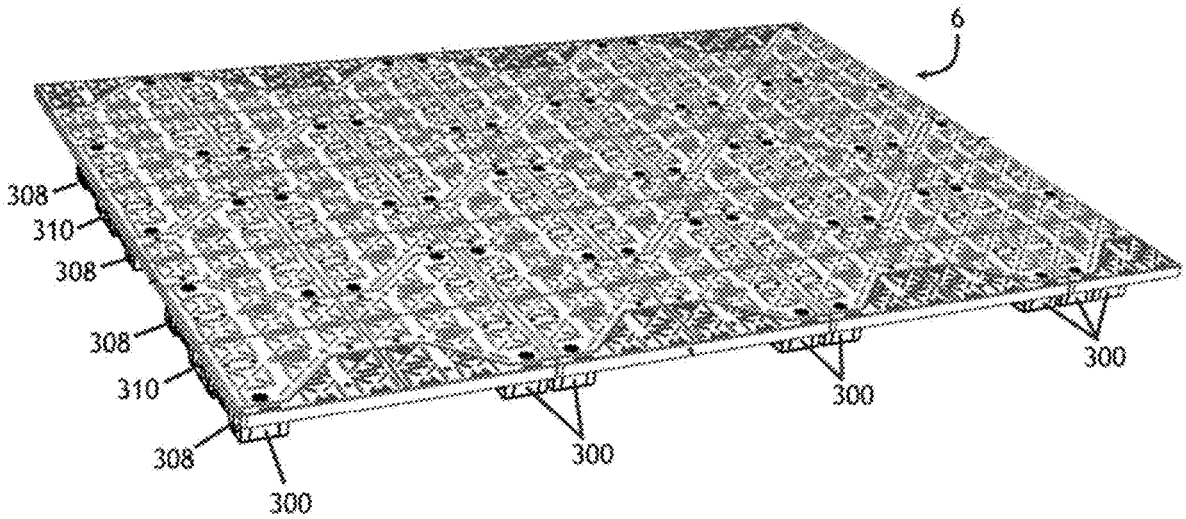
FIG. 25 is a perspective view of an assembled pad comprising main body members, half main body members, male wing members, female wing members, risers, and corner members, according to multiple embodiments and alternatives.
Figure 26:
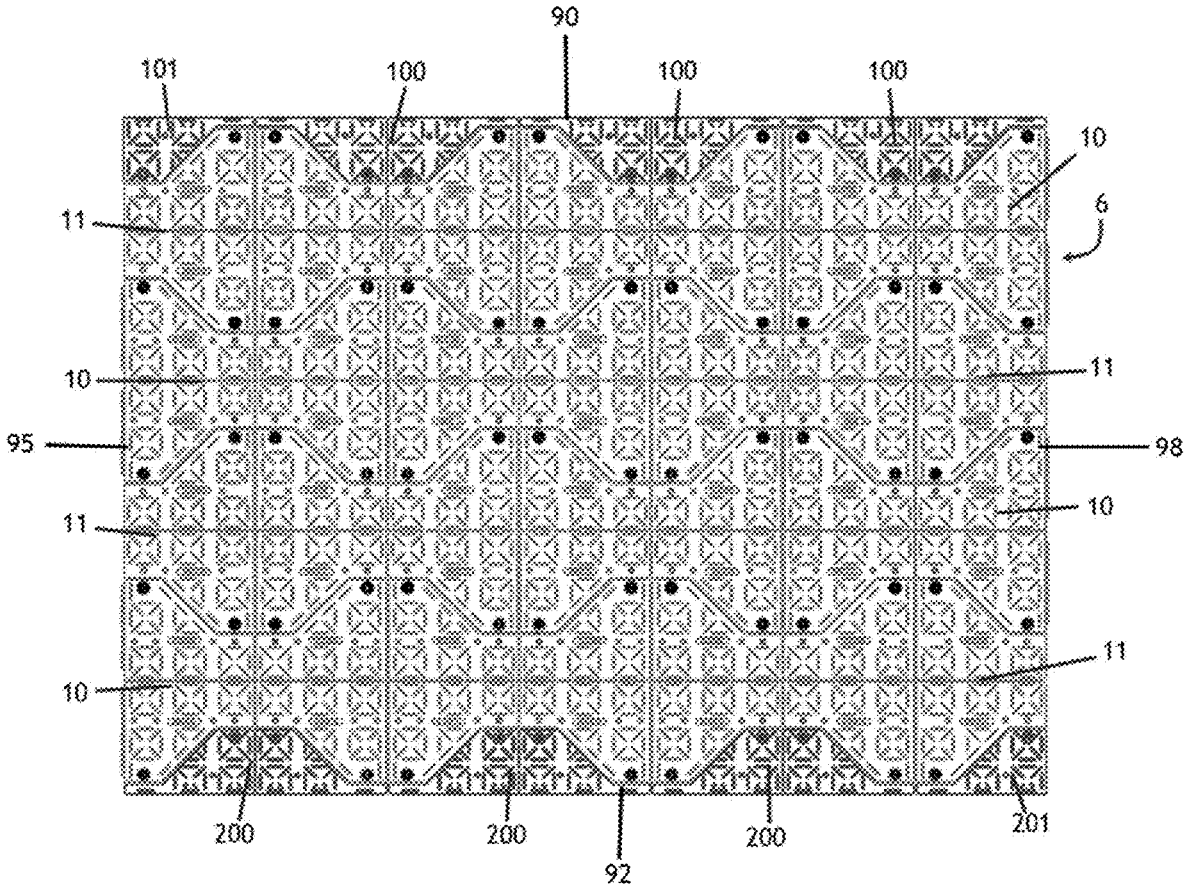
FIG. 26 is a plan view of an assembled pad comprising main body members, half main body members, male wing members, female wing members, risers, and corner members, according to multiple embodiments and alternatives.
Figure 27:
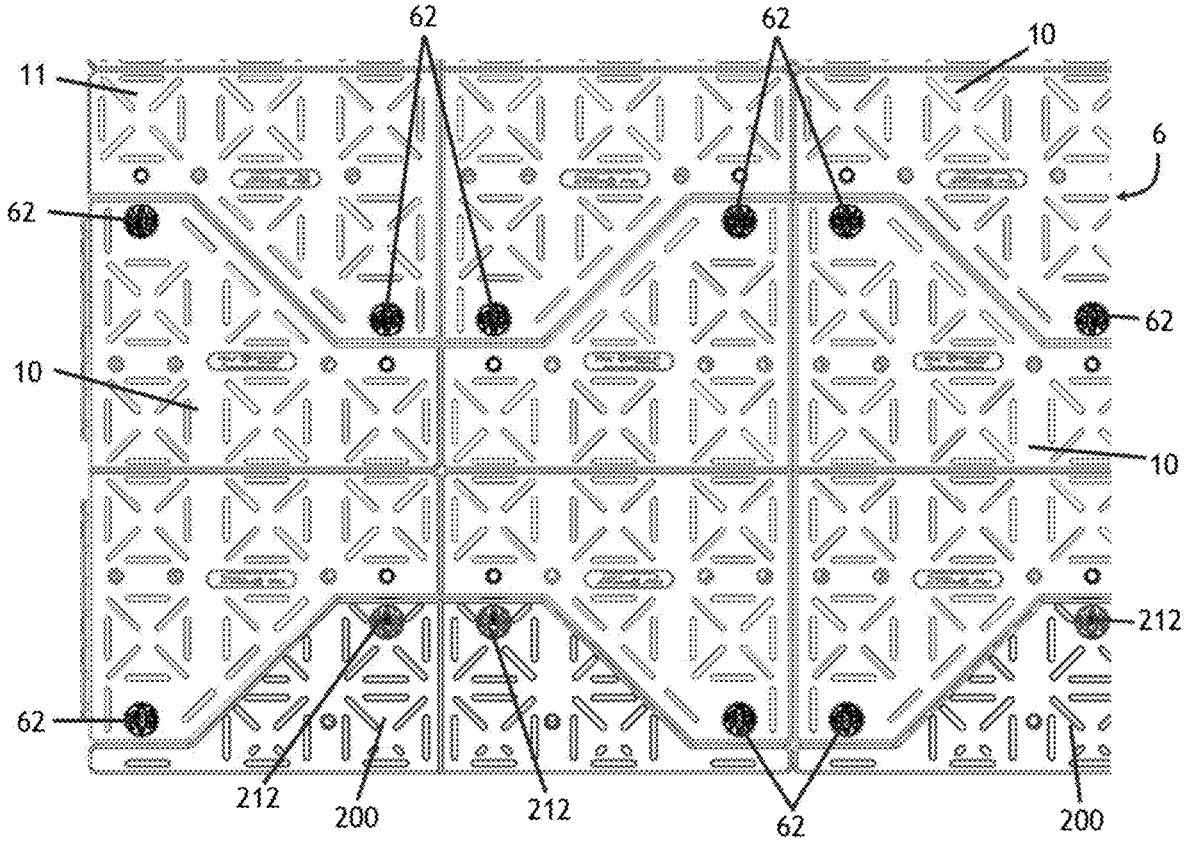
FIG. 27 is a close-up plan view of an assembled pad comprising main body members, half main body members, male wing members, female wing members, risers, and corner members, according to multiple embodiments and alternatives.
Figure 28:
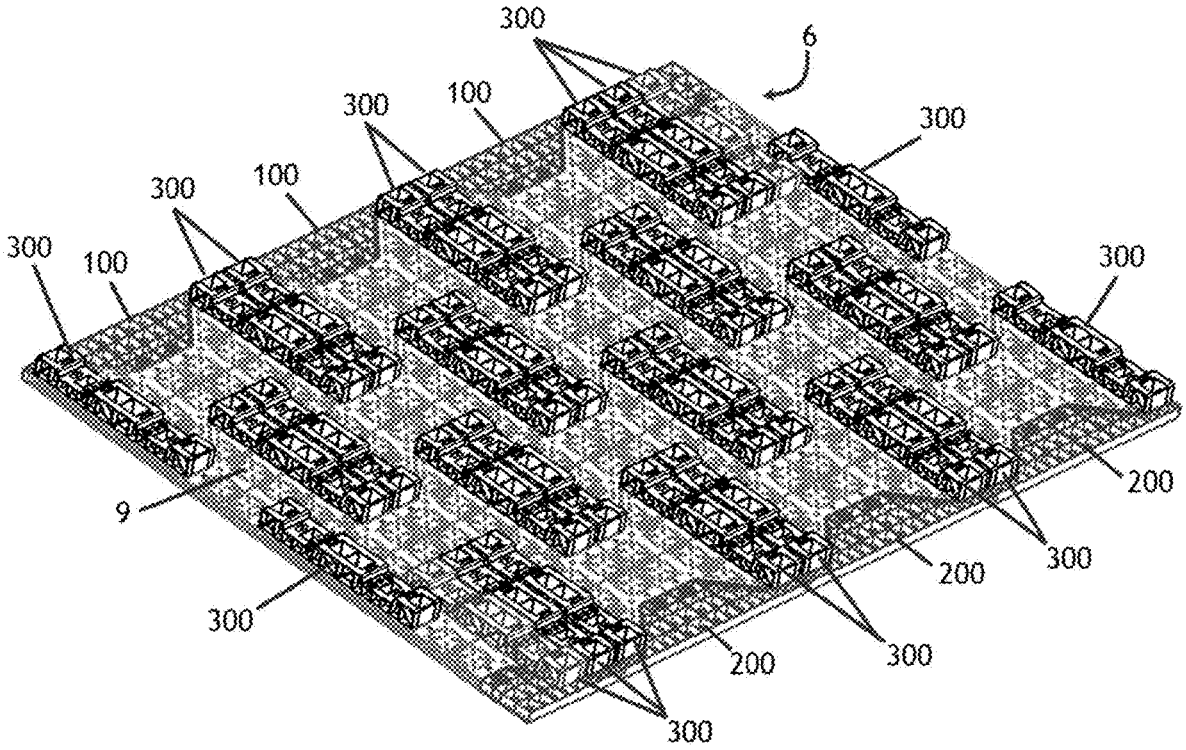
FIG. 28 is a bottom perspective view of an assembled pad comprising main body members, half main body members, male wing members, female wing members, risers, and corner members, according to multiple embodiments and alternatives.

As illustrated in FIGS. 25 & 28, the pad 6 can be elevated above the ground surface using a series of risers 300. The risers 300 are secured to the bottom 9 of pad 6 using the same method discussed above, wherein the bolt receiving holes are aligned with the bolts 400 and the nuts 402 are utilized to secure the risers 300 in place. The risers 300 can be attached to the bottom 9 of pad 6 in any number of configurations as needed by the user, including but not limited to the pattern of risers 300 illustrated in FIG. 28. As shown in these figures, the bottom 9 of pad 6 is characterized by the bottom surfaces of the male wing members, the female wing members, and the corner members. As previously noted, the upward and downward facing surface of the main body member 10 are identical and thus can be utilized in either orientation. However, to create the pad 6, it is most beneficial to the user for the top surfaces of the male and female wing members to each face upwards and for the bottom surfaces to face downwards.

Figure 29:
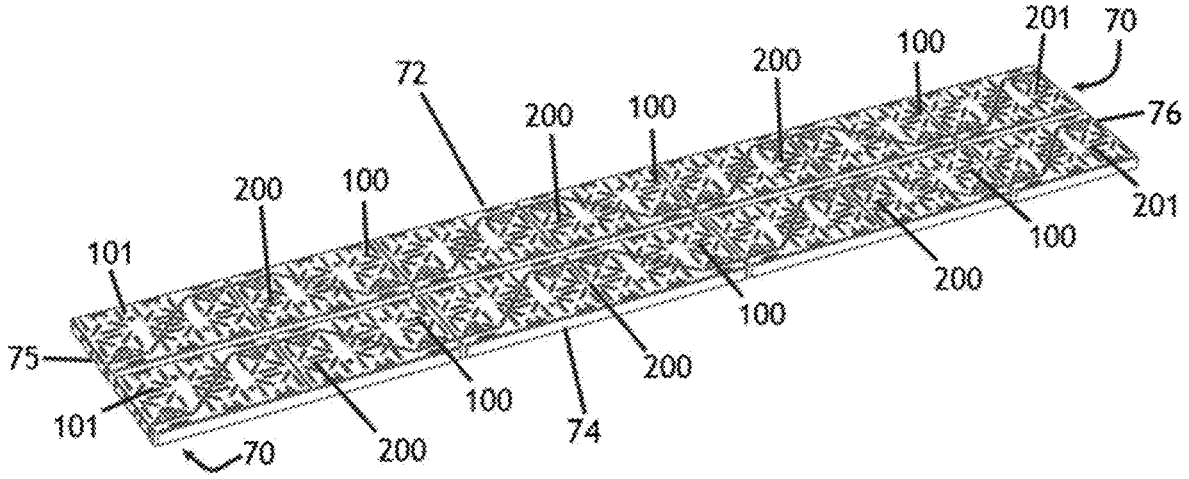
FIG. 29 is a perspective view of a pair of assembled arrays comprising male and female body members and corner members, according to multiple embodiments and alternatives.
Figure 30:
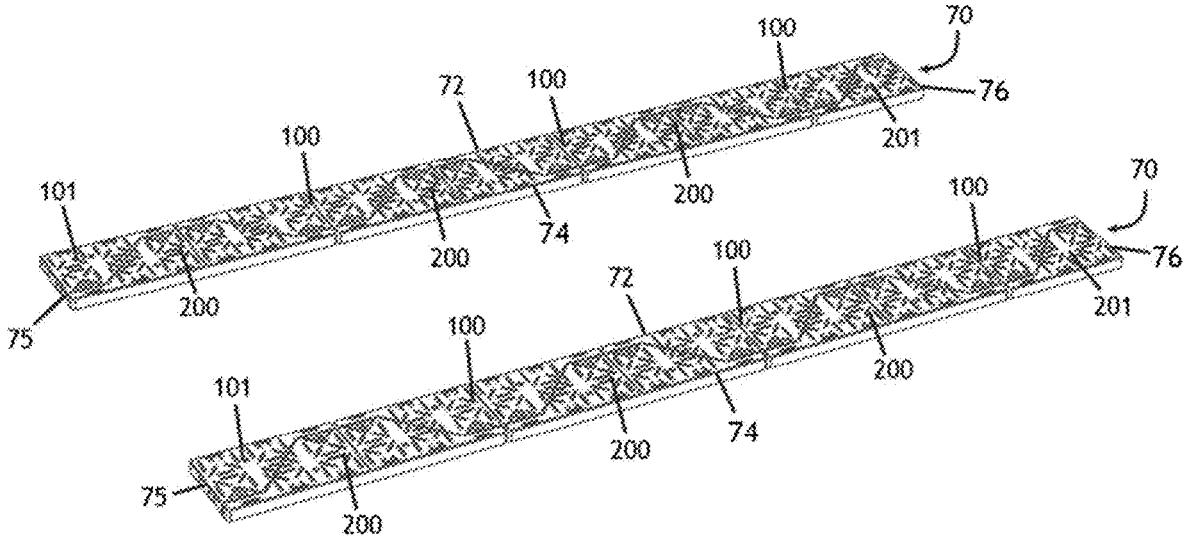
FIG. 30 is a perspective view of a pair of assembled elongated rectangles comprising male and female body members and corner members, according to multiple embodiments and alternatives.
Figure 31:
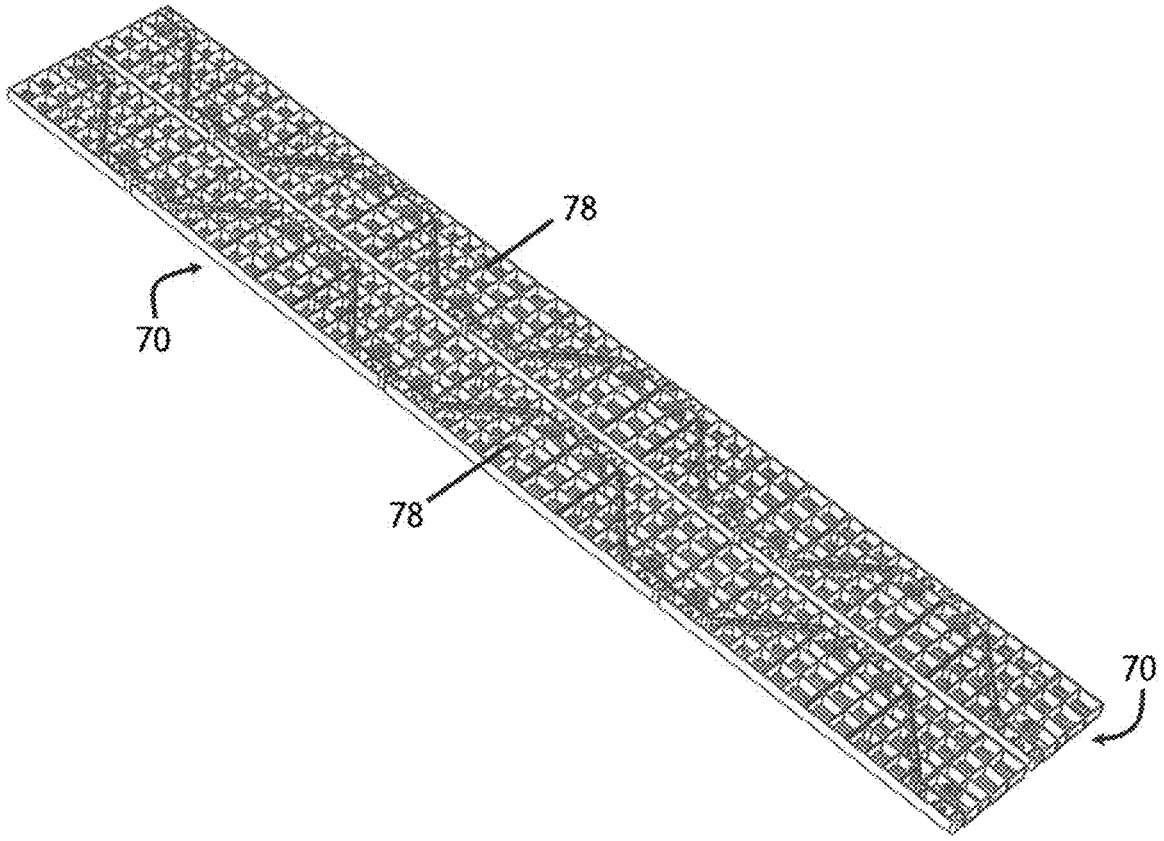
FIG. 31 is a bottom perspective view of a pair of assembled arrays comprising male and female body members and corner members, according to multiple embodiments and alternatives.

In addition, the male and female wing members may be attached to one another to create the elongated array 70 illustrated in FIGS. 29-31. To create array 70 (best shown in FIG. 30), the male wing members 100 engage with the female wing members 200. These wing members are secured to one another by the various interlocking members like the corresponding fingers and notches, and the corresponding ribs and slots. To complete this array 70, the male corner member 101 and the female corner member 201 must be attached to the ends. Accordingly, as shown in FIGS. 29-30, the assembled elongated array 70 comprises a first length 72 having a length defined by male wing members 100 and the male corner member 101, and a second length 74 having a length defined by a plurality of female wing members 200 and the female corner member 201. The elongated array also comprises a first end 75 having a length defined by the male corner member 101 and a female wing member 200, and a second end 76 having a length defined by the female corner member 201 and a male wing member 100.

The user may connect any number of male and female wing members as needed to increase the first length 72 and second length 74 of array 70. Since only the male and female wing members are connected to one another, the lengths of first end 75 and second end 76 remain the same.

As illustrated in FIGS. 29 and 31, the array 70 may be placed next to another array 70 to create a wider rectangle, which may be useful for walkways and the like. While not shown in the figures, array 70 can also be elevated in the same manner disclosed herein by attaching risers 300 to the bottom 78 of array 70 using nuts and bolts.

It will be understood that the embodiments described herein are not limited in their application to the details of the teachings and descriptions set forth, or as illustrated in the accompanying figures. Rather, it will be understood that the present embodiments and alternatives, as described and claimed herein, are capable of being practiced or carried out in various ways.

Also, it is to be understood that words and phrases used herein are for the purpose of description and should not be regarded as limiting. The use herein of "including," "comprising," "e.g.," "containing," or "having" and variations of those words is meant to encompass the items listed thereafter, and equivalents of those, as well as additional items.

Accordingly, the foregoing descriptions of several embodiments and alternatives are meant to illustrate, rather than to serve as limits on the scope of what has been disclosed herein. The descriptions herein are not intended to be exhaustive, nor are they meant to limit the understanding of the embodiments to the precise forms disclosed. It will be understood by those having ordinary skill in the art that modifications and variations of these embodiments are reasonably possible in light of the above teachings and descriptions.

What is claimed is:

1. A pallet comprising:

a main body member, said main body member having a first side, a second side, a first end and a second end; and a pair of wing members each having an isosceles trapezoid part and a rectangular part;

said isosceles trapezoid part being defined by a pair of oblique lengths connected at opposing ends by a first length and an opposing second length, the second length being greater than and parallel to the first length;

said rectangular part being defined by a pair of short lengths and a pair of long lengths, the first long length being integrally connected to said second length of said isosceles trapezoid part;

wherein a pair of opposing internal faces are defined along opposing end portions of the first long length of said rectangular part between corresponding ends of said first long length of said rectangular part and corresponding ends of said second length of the isosceles trapezoid part;

wherein an internal side of said wing member is defined by the pair of internal faces, the pair of oblique lengths of said isosceles trapezoid part, and the first length of said isosceles trapezoid part;

wherein the first and second sides of the main body member are adapted to interlock with the internal side of each of the pair of wing members to form opposing sides of a rectangular pallet.

2. The pallet of claim 1, wherein each of the pair of wing members further comprises a top surface and a bottom surface, each said bottom surface having a series of spines defining a series of cells.

3. The pallet of claim 2, further comprising a plurality of risers configured to be secured to the first end of the main body member and the second end of the main body member.

4. The pallet of claim 3, wherein each of the plurality of risers have a length suitable for spanning a length of the main body member.

5. The pallet of claim 3, wherein each of the plurality of risers are further configured to be secured to the bottom surface of the pair of wing members.

6. The pallet of claim 3, wherein each of the plurality of risers have a length suitable for spanning a length between the main body member and the pair of wing members.

7. The pallet of claim 1, wherein the main body member further comprises a central section integrally connected to opposing end sections, said central section having a rectangular form and said opposing end sections each having an irregular hexagon form.

8. A weight-bearing array, comprising:

a plurality of pallets, each of said plurality of pallets having a main body member having a first side, a second side, a downward facing surface and an upward facing surface adapted to interlock with one or more other main body members, a pair of wing members, each wing member having an isosceles trapezoid part and a rectangular part;

said isosceles trapezoid part being defined by a pair of oblique lengths connected at opposing ends by a first length and an opposing second length, the second length being greater than and parallel to the first length;

said rectangular part being defined by a pair of short lengths and a pair of long lengths, the first long length being integrally connected to said second length of said isosceles trapezoid part;

wherein a pair of opposing internal faces are defined along opposing end portions of the first long length of said rectangular part between corresponding ends of said first long length of said rectangular part and corresponding ends of said second length of the isosceles trapezoid part;

wherein an internal side of said wing member is defined by the pair of internal faces, the pair of oblique lengths of said isosceles trapezoid part, and the first length of said isosceles trapezoid part;

wherein the first and second sides of each main body member are adapted to interlock with the internal side of the wing members;

wherein the main body members from said plurality of pallets are interlocked to form a central portion of said array and a subset of the wing members are interlocked with the main body members along opposite edges of said central portion to form opposing sides of said array.

9. The weight-bearing array of claim 8, further comprising:

a plurality of half main body members adapted to interlock with one or more main body members; and a plurality of corner members adapted to interlock with both one or more main body members and the plurality of half main body members;

wherein said plurality of half main body members interlock with one or more main body members, and said plurality of corner members interlock with one or more main body members and the plurality of half main body members to form a rectangular array.

10. The weight-bearing array of claim 9, wherein each of the plurality of half main body members have a central member integrally connected to a first end unit and a second end unit, said first end unit having a rectangular form and the second end unit having a rectangular form larger than the first end unit.

11. The weight-bearing array of claim 10, wherein each of the plurality of corner members have a central unit, a first end, and a second end, said central unit having a non-isosceles trapezoid form, said first end having a rectangular form and said second end having a rectangular form larger than the first end.

12. The weight-bearing array of claim 8, wherein each of the wing members and each of the plurality of corner members further comprise a top surface and a bottom surface, each said bottom surface having a series of spines defining a series of cells.

13. The weight-bearing array of claim 12, further comprising a plurality of risers, each riser being configured to be secured to the downward facing surface of the plurality of main body members, the bottom surface of the wing members, and the bottom surface of the plurality of corner members.

14. The weight-bearing array of claim 13, wherein each of the plurality of risers has a length suitable for spanning between members of the weight-bearing array, said members comprising the main body members, the plurality of half main body members, the wing members, and the plurality of corner members.

15. The weight-bearing array of claim 8, wherein each of the main body members further comprise a central section integrally connected to opposing end sections, said central section having a rectangular form and said opposing end sections each having an irregular hexagon form.

16. An elongated weight-bearing array, comprising:

a plurality of wing members, each wing member having an isosceles trapezoid part and a rectangular part;

said isosceles trapezoid part being defined by a pair of oblique lengths connected at opposing ends by a first length and an opposing second length, the second length being greater than and parallel to the first length;

said rectangular part being defined by a pair of short lengths and a pair of long lengths, the first long length being integrally connected to said second length of said isosceles trapezoid part;

wherein a pair of opposing internal faces are defined along opposing end portions of the first long length of said rectangular part between corresponding ends of said first long length of said rectangular part and corresponding ends of said second length of the isosceles trapezoid part;

wherein an internal side of said wing member is defined by the pair of internal faces, the pair of oblique lengths of said isosceles trapezoid part, and the first length of said isosceles trapezoid part;

wherein the internal side of the plurality of wing members is adapted to interlock with the internal side of other wing members to form opposing sides of said elongated array.

17. The elongated weight-bearing array of claim 16, further comprising a plurality of corner members adapted to interlock with the plurality of wing members to form a rectangular array.

18. The elongated weight-bearing array of claim 17, wherein each of said plurality of corner members have a central unit, a first end, and a second end, said central unit having a non-isosceles trapezoid form, said first end having a rectangular form and said second end having a rectangular form larger than the first end.

* * * * *